US006141925A

United States Patent [19]

Halvorson, Jr. et al.

[11] Patent Number: 6,141,925

[45] Date of Patent: Nov. 7, 2000

[54] CLEAR WALL PANEL SYSTEM

[75] Inventors: Harold Halvorson, Jr., Grand Rapids; Gary S. Juhlin, Caledonia; David M. Lewis, Detroit, all of Mich.; James H. Davies, Toronto, Canada; Richard A. Benoit, East Grand Rapids, Mich.; Robert J. Luchetti, Cambridge; Peter C. Greenberg, Somerville, both of Mass.

[73] Assignee: Steelcase Development Inc., Grand Rapids, Mich.

[21] Appl. No.: 09/037,476

[22] Filed: Mar. 10, 1998

[51] Int. Cl.[7] ..... E04B 2/00

[52] U.S. Cl. ..... 52/238.1; 52/126.3; 52/126.4; 52/242; 52/220.7; 52/211; 52/213; 52/204.53; 52/204.6; 52/204.7; 52/717.01; 52/476; 52/489.2; 52/775

[58] Field of Search ..... 52/126.3, 126.4, 52/208, 211–213, 204.53, 204.54, 204.6, 204.62, 204.7, 220.7, 238.1, 242, 243, 243.1, 475.1, 476, 483.1, 489.1, 489.2, 764, 717.01, 775

[56] References Cited

U.S. PATENT DOCUMENTS

| | | | |
|---|---|---|---|
| 1,724,821 | 8/1929 | Bohnsack . | |
| 1,900,177 | 3/1933 | Fien | 52/476 |
| 2,766,855 | 10/1956 | Johnson et al. | 52/126.6 |
| 3,020,605 | 2/1962 | Lemme | 52/775 X |
| 3,071,215 | 1/1963 | Gall . | |
| 3,189,140 | 6/1965 | Luss | 52/126.4 |
| 3,195,698 | 7/1965 | Codrea . | |
| 3,352,078 | 11/1967 | Neal | 52/243 X |
| 3,371,454 | 3/1968 | Anderson | 52/126.4 |
| 3,403,491 | 10/1968 | Eichman | 52/476 X |
| 3,411,252 | 11/1968 | Boyle | 52/126.4 |
| 3,455,080 | 7/1969 | Meadows | 52/476 |
| 3,462,892 | 8/1969 | Meyer | 52/220.7 X |
| 3,475,870 | 11/1969 | Birum | 52/775 X |
| 3,501,884 | 3/1970 | Cesare, Jr. et al. | 52/476 X |
| 3,504,465 | 4/1970 | Brinker | 52/238.1 X |
| 3,691,709 | 9/1972 | Ostborg . | |
| 3,782,064 | 1/1974 | Hubbard et al. . | |
| 3,881,287 | 5/1975 | Biebuyck . | |
| 3,916,595 | 11/1975 | Biebuyck | 52/476 X |
| 3,918,231 | 11/1975 | Kessler | 52/476 X |
| 3,961,452 | 6/1976 | Hubbard et al. . | |
| 3,995,405 | 12/1976 | Peterson | 52/476 X |
| 4,112,643 | 9/1978 | Decker . | |
| 4,158,936 | 6/1979 | Fulton . | |
| 4,207,717 | 6/1980 | Hubbard . | |
| 4,361,994 | 12/1982 | Carver | 52/238.1 |
| 4,535,577 | 8/1985 | Tenser et al. | 52/242 X |
| 4,574,547 | 3/1986 | Menchetti et al. . | |
| 4,596,098 | 6/1986 | Finkbeiner et al. . | |
| 4,667,450 | 5/1987 | Stefnik et al. | 52/238.1 |
| 4,682,457 | 7/1987 | Spencer . | |
| 4,757,657 | 7/1988 | Mitchell et al. . | |

(List continued on next page.)

*Primary Examiner*—Robert Canfield
*Attorney, Agent, or Firm*—Price, Heneveld, Cooper, DeWitt & Litton

[57] ABSTRACT

A movable transparent panel for reconfigurable office partitions and the like is adapted for floor-to-ceiling applications which include a floor track shaped to be supported on a floor surface, and a ceiling track shaped to be supported on a ceiling surface. A panel frame is supported in a normally vertical orientation between the floor track and the ceiling track. The panel frame has vertically spaced-apart upper and lower horizontal members with a pair of vertical side members interconnecting the upper and lower horizontal members and extending therebetween to define a generally quadrilateral opening. The upper horizontal member is operably connected to the ceiling track, and the lower horizontal member is operably connected with the floor track. A substantially transparent sheet is removably connected to the frame and extends across at least the portion of the opening. A vertically adjustable support retains the frame at a selected height above the floor track to permit height adjustment and leveling of the frame to account for variations in the floor surface.

85 Claims, 23 Drawing Sheets

U.S. PATENT DOCUMENTS

| | | | |
|---|---|---|---|
| 4,831,804 | 5/1989 | Sayer | 52/204.7 X |
| 4,841,699 | 6/1989 | Wilson et al. . | |
| 4,852,317 | 8/1989 | Schiavello et al. . | |
| 4,979,346 | 12/1990 | Pollard . | |
| 5,062,246 | 11/1991 | Sykes . | |
| 5,065,556 | 11/1991 | DeLong et al. . | |
| 5,088,250 | 2/1992 | DeLong et al. . | |
| 5,095,676 | 3/1992 | Muhle | 52/476 |
| 5,099,624 | 3/1992 | Valentin . | |
| 5,125,201 | 6/1992 | Pieters et al. | 52/775 |
| 5,138,814 | 8/1992 | Giles et al. . | |
| 5,139,846 | 8/1992 | Harwegh et al. | 52/775 X |
| 5,207,037 | 5/1993 | Giles et al. . | |
| 5,274,975 | 1/1994 | Haag . | |
| 5,381,637 | 1/1995 | Farag . | |
| 5,433,046 | 7/1995 | MacQuarrie et al. | 52/238.1 |
| 5,444,958 | 8/1995 | Lu . | |
| 5,447,002 | 9/1995 | Wehrmann . | |
| 5,481,839 | 1/1996 | Lang et al. . | |
| 5,483,775 | 1/1996 | Redman . | |
| 5,491,943 | 2/1996 | Vondrejs et al. . | |
| 5,544,457 | 8/1996 | Labrecque . | |
| 5,557,894 | 9/1996 | Card . | |
| 5,592,787 | 1/1997 | Ophardt . | |
| 5,596,850 | 1/1997 | Kubo . | |
| 5,598,672 | 2/1997 | Nawa . | |
| 5,603,192 | 2/1997 | Dickson . | |
| 5,644,877 | 7/1997 | Wood | 52/126.3 X |
| 5,653,073 | 8/1997 | Palmer . | |
| 5,657,591 | 8/1997 | Kitada . | |
| 5,661,945 | 9/1997 | Henriksson et al. . | |
| 5,673,531 | 10/1997 | Carcedo et al. . | |
| 5,675,946 | 10/1997 | Verbeek et al. . | |
| 5,682,714 | 11/1997 | Ishikuro et al. . | |
| 5,713,167 | 2/1998 | Durham et al. | 52/204.54 |
| 5,822,935 | 10/1998 | Mitchell et al. | 52/475.1 X |

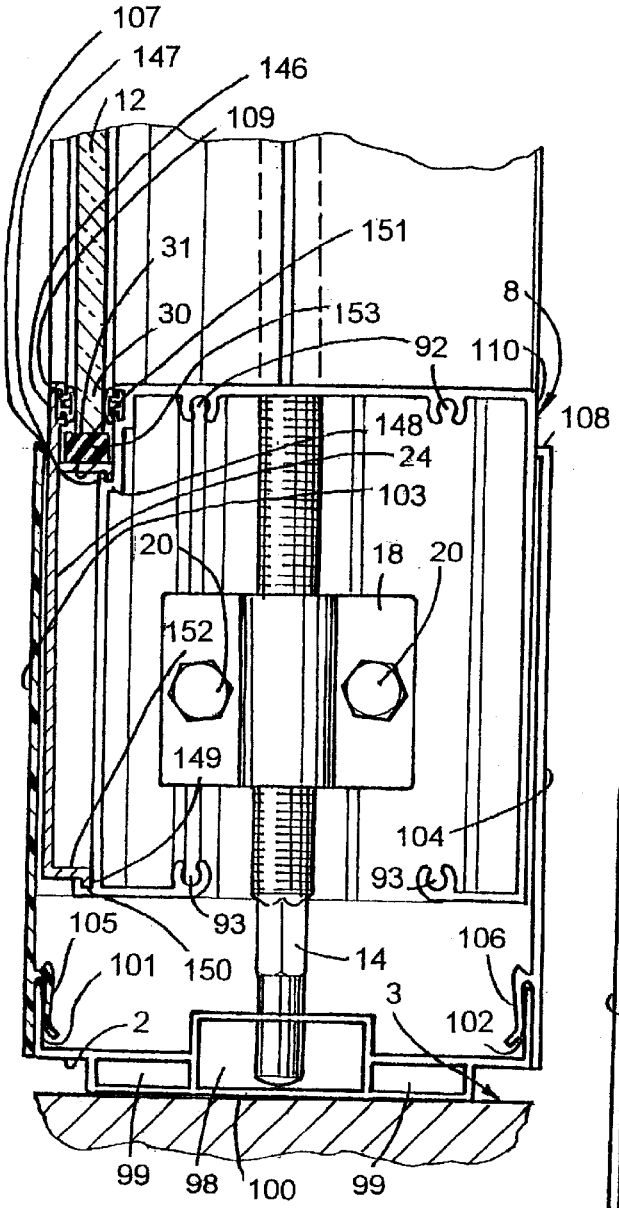
Fig. 11
Fig. 12
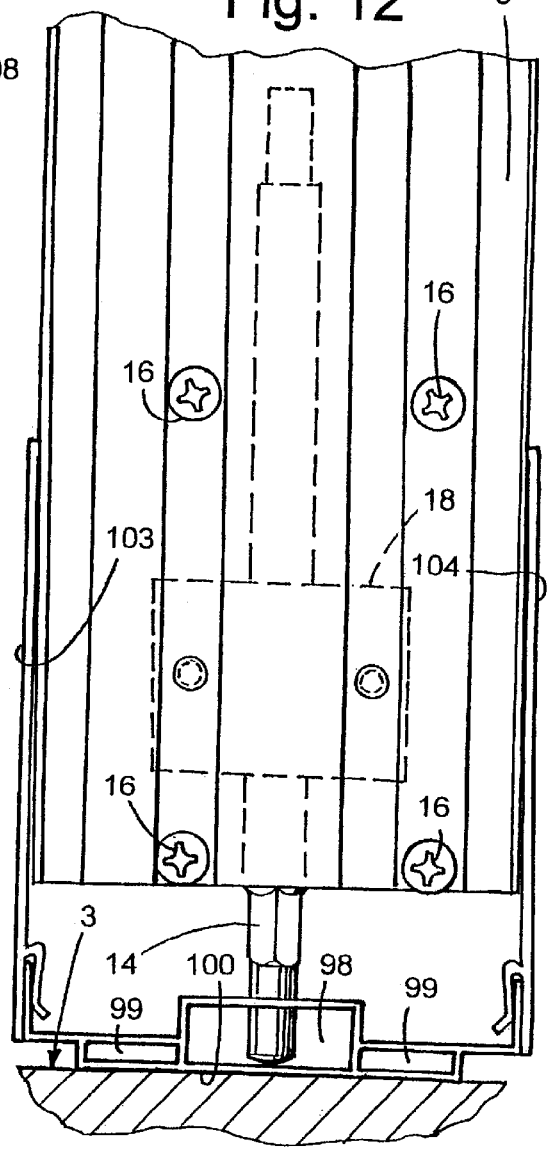

Fig. 13
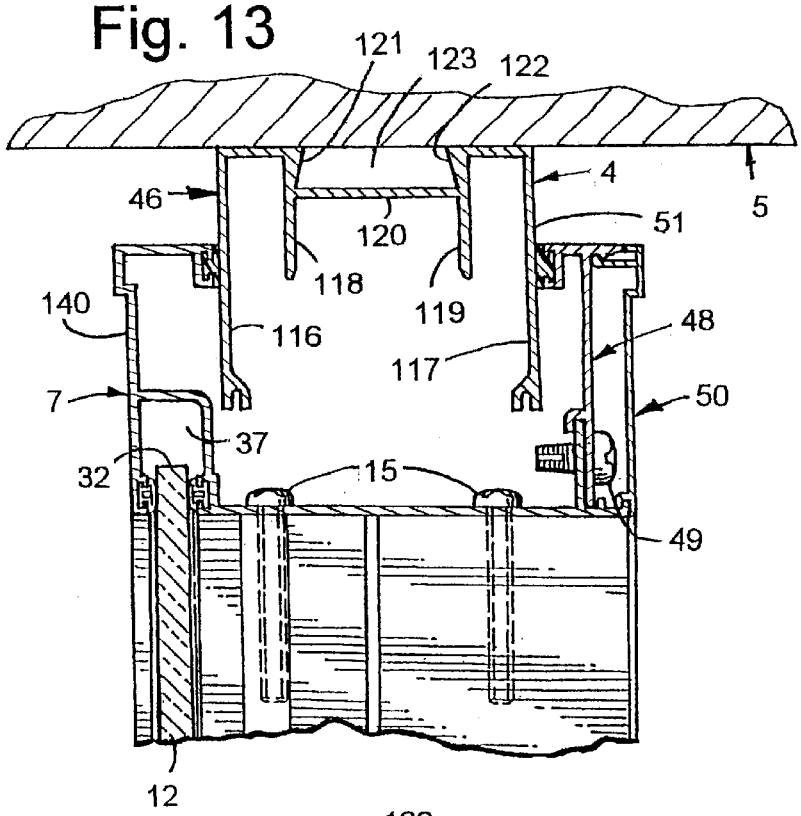
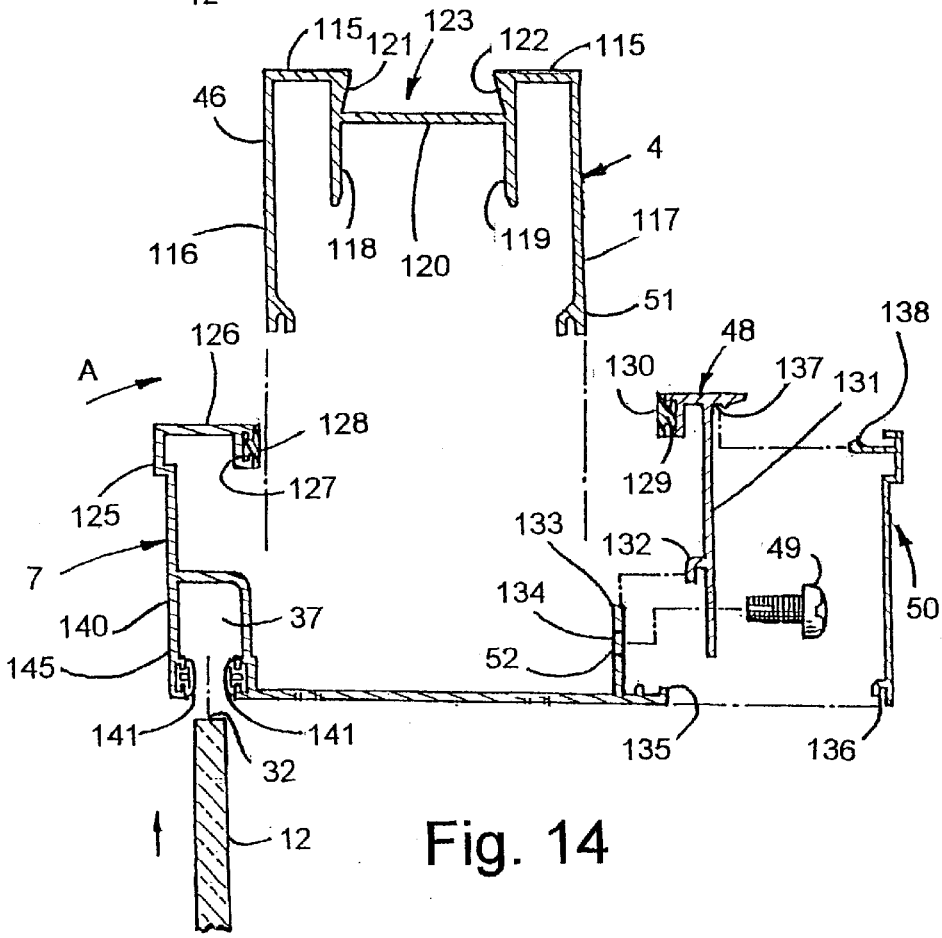
Fig. 14

CLEAR WALL PANEL SYSTEM

CROSS-REFERENCES TO RELATED APPLICATION

The present application is related to the following, commonly assigned, copending United States patent applications, which are hereby incorporated herein by reference.

| application Ser. No. | Filing Date | Title |
|---|---|---|
| 09/037,840 | March 10, 1998 | VARIABLE WIDTH END PANEL |
| 09/038,371 | March 10, 1998 | WALL PANEL PARTITION SYSTEM |
| 09/037,478 | March 10, 1998 | ADJUSTABLE DOORWAY STRUCTURE |
| 09/038,370 | March 10, 1998 | OVERHEAD STRUCTURES FOR WALL SYSTEM |
| 08/367,804 | December 30, 1994 | INTEGRATED PREFABRICATED FURNITURE SYSTEM FOR FITTING-OUT OPEN PLAN BUILDING SPACE |
| 08/579,614 | December 26, 1995 | PARTITION SYSTEM |

BACKGROUND OF THE INVENTION

The present invention relates to the finishing or fitting-out of building space and the like of the type having a generally open plan interior, and in particular to an integrated prefabricated furniture system that includes clear or transparent wall panel modules.

The finishing or fitting-out of building spaces for offices, medical treatment facilities, and other areas where work is conducted has become a very important aspect of effective space planning and layout. Work patterns, technology, and business organizations are constantly evolving and changing. The building space users require products which facilitate change at lower cost, yet provide the privacy and aesthetic advantages of permanent floor-to-ceiling architectural wall systems. Space planning is no longer a static problem. Changing technology and changing work processes demand that a design and installation be able to support and anticipate change.

These space planning challenges are driven largely by the fact that modern office spaces are becoming increasingly more complicated and sophisticated due to increasing needs of the users for improved utilities support at each workstation or work setting. These "utilities," as the term is used herein, encompass all types of resources that may be used to support or service a worker, such as communications and data used with computers and other types of data processors, telecommunications, electronic displays, etc., electrical power, conditioned water, and physical accommodations, such as lighting, HVAC, sprinklers, security, sound masking, and the like. For example, modern offices for highly skilled "knowledge workers" such as engineers, accountants, stock brokers, computer programmers, etc., are typically provided with multiple pieces of very specialized computer and communications equipment that are capable of processing information from numerous local and remote data resources to assist in solving complex problems. Such equipment has very stringent power and signal requirements, and must quickly and efficiently interface with related equipment at both adjacent and remote locations. Work areas with readily controllable lighting, HVAC, sound masking, and other physical support systems, are also highly desirable to maximize worker creativity and productivity. Many other types of high technology equipment and facilities are also presently being developed which will need to be accommodated in the work places of the future.

The efficient use of building floor space is also an ever-growing concern, particularly as building costs continue to escalate. Open office plans have been developed to reduce overall office costs, and generally incorporate large, open floor spaces in buildings that are equipped with modular furniture systems, which are readily reconfigurable to accommodate the ever-changing needs of a specific user, as well as the divergent requirements of different tenants. One arrangement commonly used for furniture open plans includes movable partial height partition panels that are detachably interconnected to partition off the open spaces into individual work settings and/or offices. Such partial height partition panels are configured to receive hang-on furniture units, such as worksurfaces, overhead cabinets, shelves, etc., and are generally known in the office furniture industry as "systems furniture." Another arrangement for dividing and/or partitioning open plans involves the use of modular furniture, in which a plurality of differently shaped, complementary freestanding furniture units are positioned in a side-by-side relationship, with upstanding partial height privacy screens available to attach to selected furniture units to create individual, distinct work settings and/or offices. All of these types of modular furniture systems have been widely received due largely to their ability to be readily reconfigured and/or moved to a new site, since they are not part of a permanent leasehold improvement.

In order to gain increased efficiency in the use of expensive office real estate, attempts are now being made to try to support highly paid knowledge workers with these types of modular furniture systems in open office settings, instead of conventional private offices. However, in order to insure peak efficiency of such knowledge workers, the work settings must be equipped with the various state-of-the-art utilities and facilities discussed above. Since such work settings must be readily reconfigurable to effectively meet the everchanging needs of the use, the distribution and control of utilities throughout a comprehensive open office plan has emerged as a major challenge to the office furniture industry. The inherent nature of modular furniture systems, which permits them to be readily reconfigurable into different arrangements, makes it very difficult to achieve adequate utility distribution and control.

Today's office workers need new flexible alternative products for the creation of individual and collaborative spaces which allow the expression of the cultural aims of the organization, express the creativity of the designer, provide a "sense of place" for the users, and provide a competitive edge for the developer. These needs include a full range of privacy options, from fully enclosed offices which support individual creative work to open spaces for collaborative team work. The products must also be able to accommodate diverse organizations, unique design signatures, and constantly changing work processes. Workers also need effective lighting, better air quality, life safety, and ergonomic task support to promote productivity, minimize the expenses of absenteeism and workman's compensation, and reduce potential liability, which collectively make the building more desirable to prospective clients.

Hence, utility distribution and control are fast becoming one of the major issues in office fit-out and furniture. Changing technology is creating greater demands on power and signal distribution networks. As businesses become more aware of the impact of proper ventilation and climate control on employee health and performance, HVAC is becoming more important as well. The current disposition of HVAC, lighting, and fire protection in the ceiling creates a separation between these services and the work settings below leading to inefficient and inaccurate systems. routing power and signal distribution below the floor or in furniture systems often ends up in complex idiosyncratic systems which are difficult to manage or change.

Furthermore, due to dimension variations in existing permanent building walls, ceiling, and floors, space-dividing systems must be adaptable to accommodate these variables. Meeting the varied requirements of particular office workers often requires a combination of full and partial height dividers. However, presently available full height architectural walls are not readily reconfigurable. In addition, available full height architectural dividers are not readily interconnected with partial height partition panels, and also do not provide integrated utility distribution between the various types of dividers in the office space.

There is presently an oversupply of office space and furniture systems which do not properly respond to or support change. Many older buildings do not have adequate utility capabilities, and the cost of conventional renovations or improvements often renders the same impractical. Even relatively new buildings can be quickly rendered obsolete by the fast paced changes in modern technology. The refurbishing of existing building space is herefore a concern which must be addressed by furniture systems.

One type of demountable wall which may be used as a part of a solution to those issues noted above is a clear or transparent partition. Conventional clear partitions are typically of the portable, freestanding type, or are custom built floor-to-ceiling installations. While the latter provide increased privacy, their cost is relatively high and installation somewhat difficult and time consuming. Furthermore, prior clear panels have not adequately addressed the aforementioned concerns of routing utilities through the partition system. The clear panel retainer arrangements used in prior clear panels have also been rather complex, and difficult to assemble and disassemble efficiently. Prior clear panels have also been difficult to effectively integrate with solid panels in a complete furniture system and maintain both functional and aesthetic continuity.

SUMMARY OF THE INVENTION

One aspect of the present invention is to provide a movable transparent panel for reconfigurable floor-to-ceiling office partitions and the like. The panel includes a floor track shaped to be supported on a floor surface, and a ceiling track shaped to be supported on a ceiling surface. A panel frame is supported in a normally vertical orientation between the floor track and the ceiling track. The panel frame has vertically spaced-apart upper and lower horizontal members with a pair of vertical side members interconnecting the upper and lower horizontal members and extending therebetween to define a generally quadrilateral opening. The upper horizontal member is operably connected to the ceiling track, and the lower horizontal member is operably connected with the floor track. A substantially transparent sheet is removably connected to the frame and extends across at least the portion of the opening. A vertically adjustable support retains the frame at a selected height above the floor track to permit height adjustment and leveling of the frame to account for variations in the floor surface.

Another aspect of the present invention is a kit for dividing office spaces and the like. The kit includes a floor track shaped to be supported on a floor surface, and a ceiling track shaped to be supported on a ceiling surface. The kit also includes a pair of horizontal frame members, and a pair of vertical frame members configured to be connected with the horizontal frame members in a vertical, horizontally spaced-apart relationship to define a panel frame having a generally quadrilateral opening therein when in an assembled condition. An upper horizontal member is operably connected to the ceiling track when in an assembled condition. The kit also includes a transparent sheet that is shaped to be received in the quadrilateral opening, and a retainer adapted for connection to the panel frame when in an assembled condition to retain the transparent sheet over the quadrilateral opening. A support is adapted to interconnect the panel frame with the floor track when in the assembled condition to retain the panel frame at a selected height above the floor track to permit height adjustment and leveling of the panel frame to account for variations of the floor surface.

Yet another aspect of the present invention is a movable transparent panel for reconfiguring floor-to-ceiling office partitions and the like. A floor track is provided, shaped to be supported on a floor surface, along with a ceiling track shaped to be supported on a ceiling surface, and defining a floor-to-ceiling height between the ceiling track and the floor track. A rigid panel frame is supported in a normally vertical orientation between the floor track and the ceiling track, and has a height less than the floor-to-ceiling height. The panel frame has a base portion operably connected to the floor track and a top portion spaced vertically apart from the ceiling track. A variable height panel support extends between and is connected with the panel frame top portion and the ceiling track. The panel support is vertically extensible and includes a lock which rigidly retains the panel support at a selected height. At least one transparent sheet is connected with the panel frame, and encloses an associated portion of the same.

Yet another aspect of the present invention is a movable transparent panel for reconfigurable floor-to-ceiling office partitions and the like. The panel includes a rigid panel frame having an upper horizontal frame member shaped to support an upper portion of the panel frame to a ceiling surface, and a lower horizontal frame member shaped to support the panel frame adjacent a floor surface. The panel frame includes a pair of vertical frame members interconnected with the upper and lower horizontal frame members. The panel frame further includes an elongated horizontal expressway member having opposite ends connected to the panel frame. The expressway member is located at a generally overhead position, and is shaped for supportably routing utility lines therealong. The expressway member divides the panel frame to define upper and lower quadrilateral openings. An upper sheet is connected to the panel frame and extends across the upper opening, and a substantially transparent lower sheet is connected to the panel frame and extends across the lower opening.

Yet another aspect of the present invention is a method of dividing office spaces and the like. A planar rectangular transparent sheet defining a height and width is provided. Upper and lower frame members are also provided. A pair of side frame members have a predetermined length that is greater than the floor-to-ceiling spacing of the office space to be divided. The side frame members are cut to a length corresponding to the floor-to-ceiling spacing of the office space to be divided at the installation site. The frame members are assembled to define a panel frame having a rectangular perimeter, and the transparent sheet is connected to the panel frame. The panel frame is connected to the floor and to the ceiling a vertically disposed orientation.

Yet another aspect of the present invention is a movable transparent panel for reconfigurable floor-to-ceiling office partitions and the like. A floor track is provided, shaped to be supported on a floor surface, along with a ceiling track shaped to be supported on a ceiling surface, the ceiling track defining opposite front faces. A rigid panel frame defines a quadrilateral opening and a base portion therebelow that is operably connected with the floor track. A transparent sheet is connected to the panel frame and extends across the opening. The panel frame has an upper portion with an upwardly-protruding flange abutting a first opposite base of the ceiling track upon rotation of the panel frame to a vertical position over the floor track. A retainer is removably connected to the upper portion of the panel frame and abuts a second opposite front face of the ceiling track to removably retain the panel frame in a vertically disposed position.

Yet another aspect of the present invention is a movable transparent panel for reconfigurable office partitions and the like. The panel includes a panel frame having vertically spaced-apart lower and horizontal frame members, and a pair of horizontally spaced-apart vertical frame members extending therebetween and rigidity interconnecting the upper and lower frame members to define a generally quadrilateral opening. A substantially transparent sheet defines at least one side edge and extends across the quadrilateral opening. At least one frame member includes a transversely-oriented U-shaped channel extending along at least a portion thereof. A selected one of the side edges of the transparent sheet is received within the U-shaped channel to retain the transparent sheet to the frame. The U-shaped channel has an outer flange defining a side edge of the panel such that the transparent sheet is located directly adjacent the side edge of the panel.

Yet another aspect of the present invention is a movable transparent panel for reconfigurable office partitions and the like. The panel includes a panel frame having a vertically spaced-apart upper and lower frame members, and a pair of horizontally spaced-apart vertical frame members extending therebetween and rigidly interconnecting the upper and lower frame members to define a rectangular perimeter and pair of opposite front faces of the frame. The vertical frame members include a vertically-extending channel in at least a selected one of the opposite front faces. A substantially transparent sheet extends across the frame and defines opposite side edges. A pair of retainers each include an extension that is retained within a selected channel, and an outer flange extending over a portion of the transparent sheet along a side edge thereof to retain the sheet to the panel frame.

Yet another aspect of the present invention is a panel frame member and retainer for releasably supporting the edge of glass sheets and the like. An elongated panel frame member has a channel extending therealong. The channel defines a base wall with inner and outer side walls extending therefrom to define a generally U-shaped cross section with an opening opposite the base wall. The frame member includes an elongated portion configured to abutting support a glass sheet directly adjacent an outer edge of the inner side wall. The outer side wall includes a lip extending into the opening of the channel. A retainer strip has a generally L-shaped cross section defining first and second legs. The first leg has a base portion and an end portion extending therefrom at an obtuse angle relative to the base portion to define a V-shape. The first leg further includes an extension at the vertex of the V-shape such that upon insertion of the first leg into the channel, the end portion abuts the inner side wall and the extension abuts the lip. The second leg abuts the glass panel adjacent an edge thereof and generates a moment that is reacted by the first leg to thereby releasably retain the edge of the glass panel.

Yet another aspect of the present invention is a movable transparent panel for reconfigurable floor-to-ceiling office partitions and the like. The panel includes a panel frame having upper and lower vertically spaced-apart horizontal frame members, and a pair of horizontally spaced-apart vertical frame members rigidly interconnecting the upper and lower frame members to define a rectangular perimeter and a rectangular opening through the panel frame. At least one fastener interconnects abutting vertical frame members of adjacent panel frames, and a transparent sheet is connected to the panel frame and extends across the rectangular opening. A pair of elongated covers are removably connected to the vertical frame members, and cover the fastener to thereby provide a panel frame having substantially uniform, uninterrupted external surfaces extending along the vertical frame members.

The principal objects of the present invention are to provide an improved clear panel, which has a prefabricated, modular construction that is adapted to be used in a wide variety of floor-to-ceiling applications. The modular construction of the clear panel reduces manufacturing cost and installation time. The clear panel is specifically configured to mate both functionally and aesthetically with solid panels to create a completely integrated partition system capable of readily routing large quantities of utilities therethrough, such as power and cable lines. Preferably, the clear panel has vertically adjustable top and base members to accommodate a wide variety of applications. A unique clear panel capture mechanism provides highly efficient and effective assembly and disassembly.

These and other features, advantages and objects of the present invention will be further understood and appreciated by those skilled in the art by reference to the following specification, claims and appended drawings.

BRIEF DESCRIPTION OF THE DRAWINGS

FIG. 11 is a cross-sectional view of the glass partition taken along the line XI—XI, FIG. 6;

FIG. 12 is a side elevational view of the lower portion of the glass partition of FIG. 5;

FIG. 13 is a cross-sectional view of the glass partition taken along the line XIII—XIII, FIG. 6;

FIG. 14 is an exploded, cross-sectional view of the glass partition of FIG. 13;

DETAILED DESCRIPTION OF PREFERRED EMBODIMENT

Figure 1:
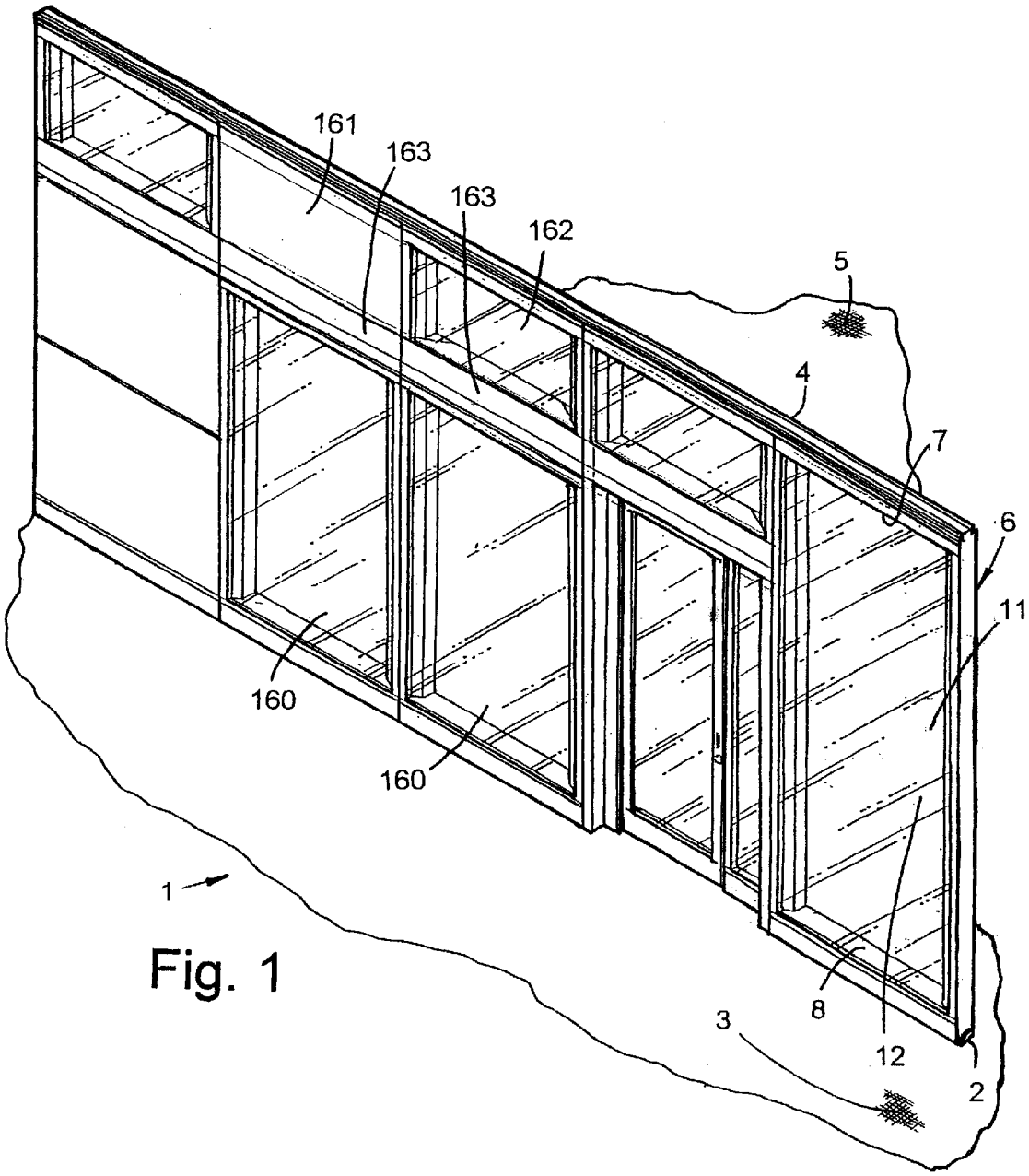
FIG. 1 is a perspective view of a movable office partition system embodying the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 1 (FIG. 1) generally designates a movable transparent panel embodying the present invention, which in the illustrated example, is particularly designed for reconfigurable floor-to-ceiling office partitions and the like. The arrangement shown in FIG. 1 includes a floor track 2 that is shaped to be supported on a floor surface 3, and a ceiling track 4 that is shaped to be supported on a ceiling surface 5. A panel frame 6 is supported in a normally vertical orientation between the floor track 2 and the ceiling track 4, and has vertically spaced-apart upper and lower horizontal frame members 7, 8 with a pair of vertical side members 9 and 10 interconnecting the upper and lower horizontal frame members 7, 8 and extending therebetween to define a generally quadrilateral opening 11 (see also FIG. 2). The upper horizontal member 7 is operably connected to the ceiling track 4, and the lower horizontal member 8 is operably connected with the floor track 2. A substantially clear or transparent sheet, such as glass sheet 12, is removably connected to the panel frame 6, and extends across at least a portion of the quadrilateral opening 11. A vertically adjustable support such as jack screws 13 and 14 retain the panel frame 6 at a selected height above the floor track 2 to permit height adjustment and leveling of the panel frame 6 to account for variations in the floor surface 3.

Figure 2:
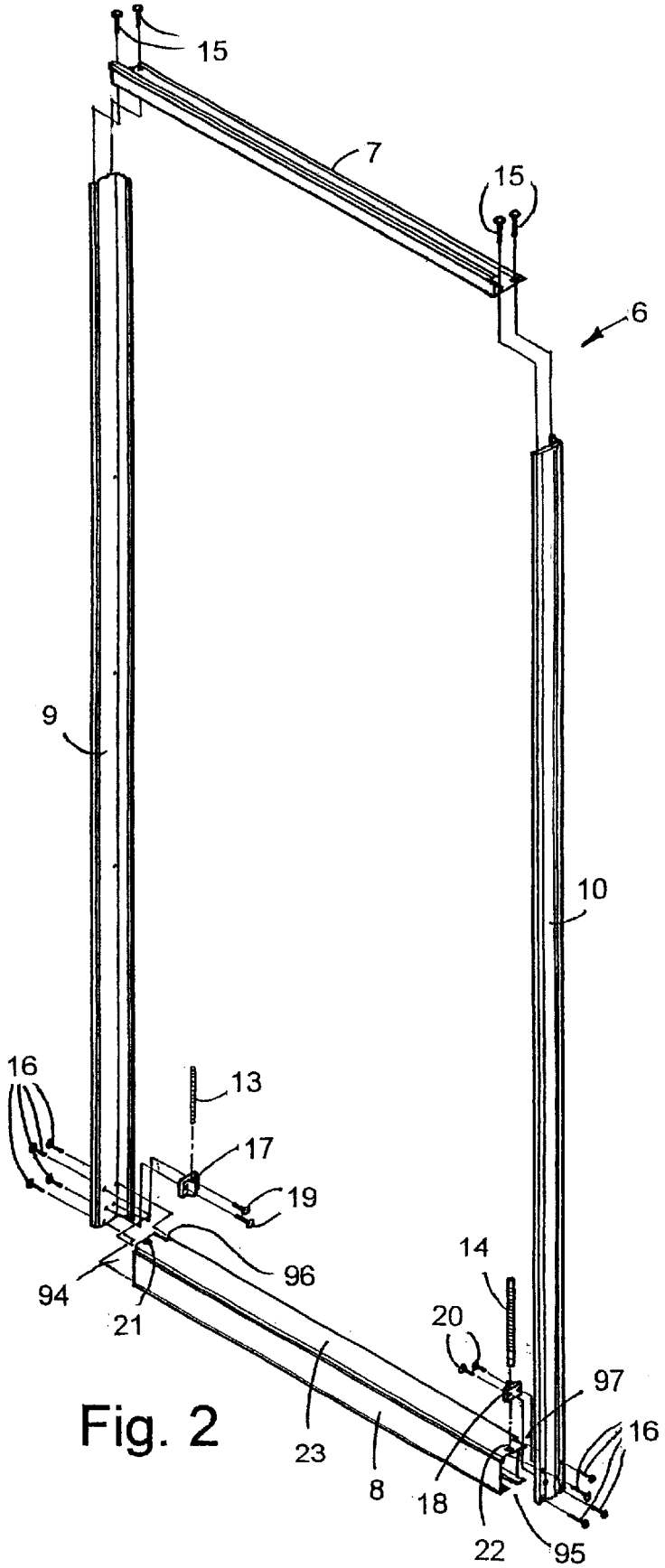
FIG. 2 is an exploded perspective view of the panel frame.

With reference to FIG. 2, the upper horizontal frame member 7 is removably secured to the vertical side members 9 and 10 by fasteners 15. The vertical side members 9, 10 are connected to the lower horizontal frame member 8 by fasteners 16. As described in more detail below, the fasteners 15 and 16 are received within generally cylindrically-shaped passages which extend along vertical side members 9, 10 as well as lower horizontal member 8. Threaded members 18 and 17 receive jack screws 13 and 14, and are secured to the side members 9, 10 by means of fasteners 19 and 20. Clearance holes 21 and 22 are located in the upper surface 23 of the lower horizontal frame member 8 adjacent each end thereof, and provide clearance for jack screws 13 and 14 when in an assembled condition. In the preferred embodiment, the frame members 7, 8, 9 and 10 are each extruded aluminum members. As discussed below, after adjusting jack screws 13 and/or 14, a cover 26 is connected to side frame members 9 and 10 to cover the jack screws and provide a finished appearance.

Figure 3:
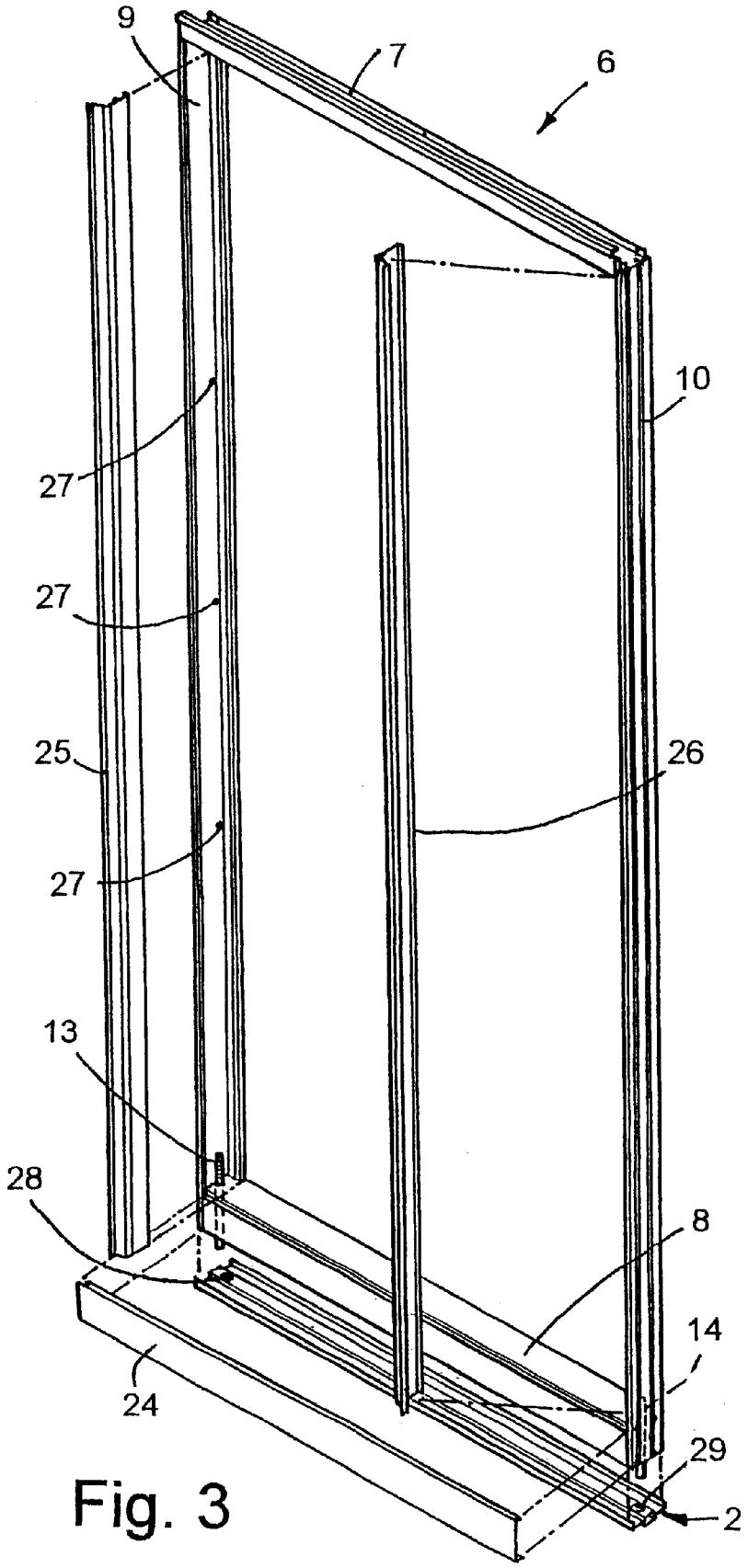
FIG. 3 is an exploded perspective view of the panel frame showing the floor track and trim.

With reference to FIG. 3, base cover 24 is attached to lower horizontal member 8, and vertical trim pieces 25 and 26 are connected to the vertical side frame members 9, 10. A plurality of depressions for drilling clearance holes 27 are provided along the vertical side frame members 9 and 10. Alternatively, holes 27 could be pre-drilled. As described in more detail below, clearance holes 27 receive fasteners that bolt adjacent panel frames 6 together. Clearance holes 27 may also be used to interconnect the glass partition 1 with an adjustable doorway structure (FIG. 1) described in above-referenced U.S. Patent Application entitled "ADJUSTABLE DOORWAY STRUCTURE." Furthermore, clearance holes 27 may also be used to interconnect the glass partition 1 with a solid panel (FIG. 1) such as that disclosed in above-referenced U.S. Patent Application entitled "WALL PANEL PARTITION SYSTEM." Accordingly, an integrated partition including doorways, clear partition panels, and solid partition panels can be easily assembled and installed as required for a particular application. Furthermore, the partition can be easily disassembled and reconfigured if the user's requirements change. The vertical trim pieces 25 and 26 cover the jack screws 13, 14, as well as the fasteners that are received in clearance holes 27, thereby providing continuous, smooth external surfaces which give the glass panel an appearance that is similar to permanent partition wall panels, while simultaneously providing a glass panel that can be disassembled and/or moved. Furthermore, because trim pieces 25, 26 and frame members 7–10 may be extruded aluminum, a consistent "structural" appearance is provided. Clearance holes 28 and 29 in floor track 2 receive the lower end of jack screws 13 and 14 to adjustably support and locate the glass partition above the floor track 2.

Figure 4:
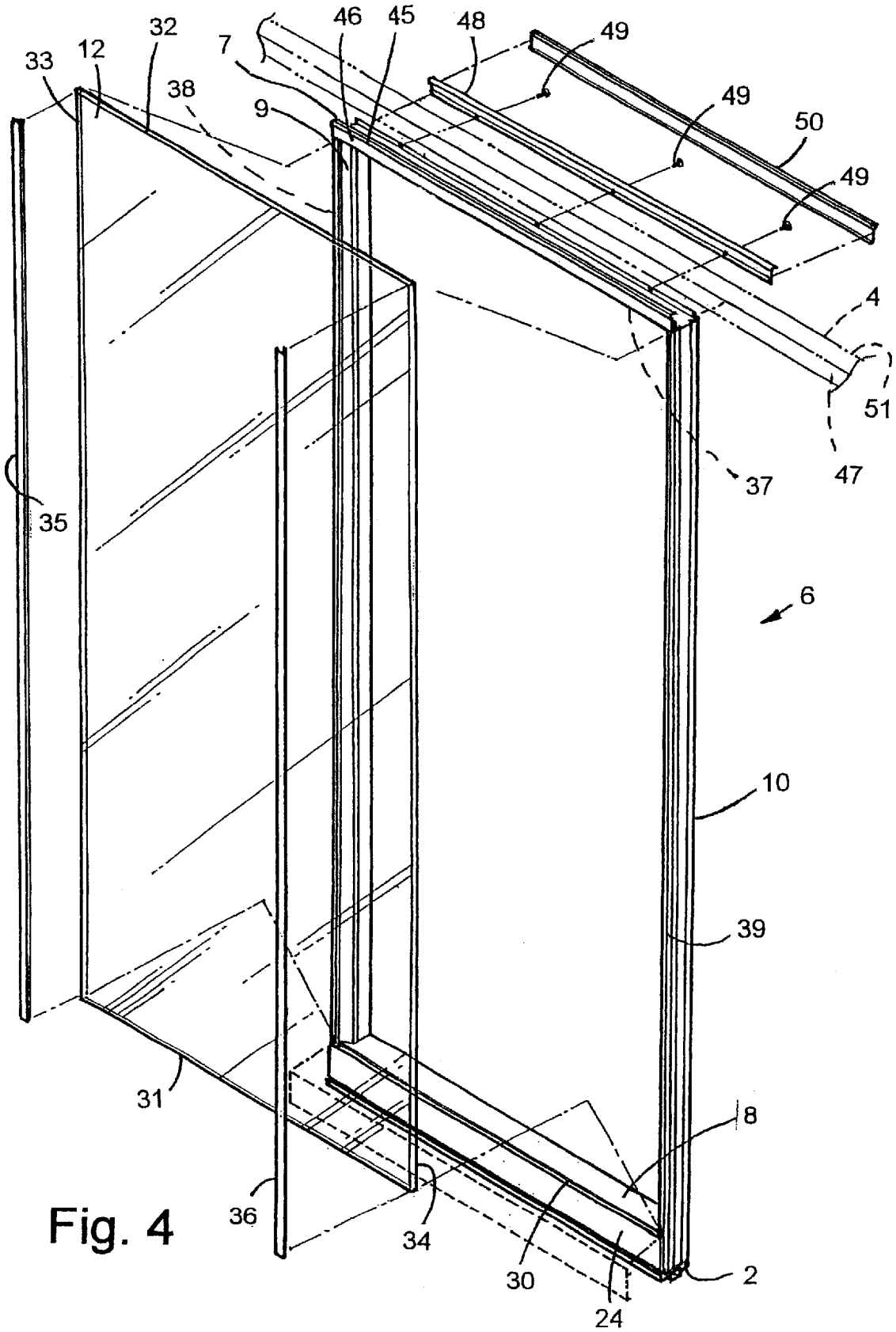
FIG. 4 is an exploded perspective view of the glass partition showing the installation of the glass, and the connection to the ceiling track.
Figure 7:
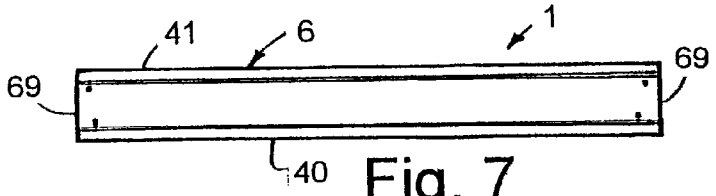
FIG. 7 is a top elevational view of the glass partition.

As best seen in FIG. 4, glass sheet 12 defines a lower edge 31, an upper edge 32, and side edges 33 and 34. As described in more detail below, when in the installed condition, base cover 24 and lower horizontal frame member 8 form an upwardly-opening U-shaped channel 30 that receives the lower edge 31 of glass sheet 12. Upper horizontal frame member 7 includes a downwardly-opening U-shaped channel 37 that receives upper edge 32 of glass sheet 12. Retainer strips 35 and 36 have a generally L-shaped cross section with a first leg that is received into channels 38 and 39 of vertical frame members 9 and 10 to removably retain the side edges 33, 34 of glass sheet 12 to the panel frame 6. Upper horizontal member 7 includes an upwardly-extending flange portion located along front side face 46 that abuts a side 47 of the ceiling track 4 when the panel frame 6 is in a vertically disposed orientation. A retainer strip 48 is fastened to the upper horizontal frame member 7 by fasteners 49, and abuts an opposite side face 51 of ceiling track 4, thereby supportably retaining the panel frame 6 in a vertical orientation. Upper horizontal trim strip 50 is removably connected to the retainer 48 to cover fasteners 49, thereby providing external surfaces that are substantially similar on both sides of the glass panel. If required, vertical frame members 9 and 10, covers 25 and 26, and retainers 35 and 36 can be cut to length corresponding to the floor-to-ceiling spacing of the office space. Glass sheet 12 is also cut to size and then tempered at a processing facility. Horizontal frame members 7 and 8 and related horizontal components may also be cut to fit if a custom width glass partition is required.

Figure 5:
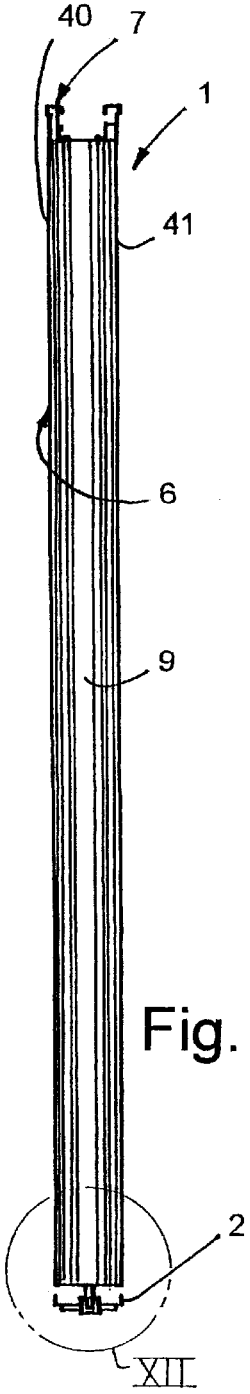
FIG. 5 is a side elevational view of the glass partition.

With reference to FIG. 5, glass partition 1 includes a front face 40, a rear face 41, and a pair of opposite side edges 69. As described in more detail below, the glass sheet 12 is disposed directly adjacent the front face 40 of the panel frame 6. Furthermore, the opposite side edges 33 and 34 of the glass sheet 12 extend outwardly beyond the inner sidewalls 54 of the vertical trim or covers 25 and 26, such that the side edges 33 and 34 of the glass sheet 12 are located immediately adjacent the side edges 69 of the frame 6. Accordingly, the retainers 36 are relatively narrow, thereby maximizing the glass area along the front face 40 of the glass partition 1.

Figure 8:
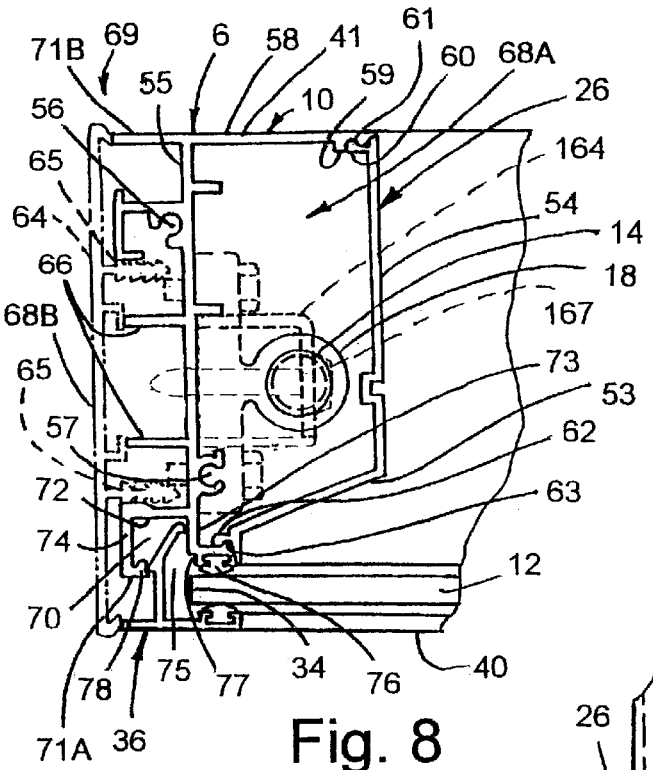
FIG. 8 is a cross-sectional view of the glass partition taken along the line VIII—VIII, FIG. 6.

With reference to FIG. 8, vertical side frame member 10 includes front face 71A, rear face 71B, inner face 68A, and outer face 68B. Vertical frame members 9 and 10 are substantially identical except that vertical frame member 9 is inverted relative to frame member 10, such that when assembled, frame member 9 is a "mirror image" of frame member 10 illustrated in FIG. 8. Accordingly, vertical frame member 9 will not be described in detail with reference to FIG. 8. Vertical frame member 10 comprises an aluminum extrusion having a main web 55 and a pair of screw bosses 56 and 57 that threadably receive fasteners 15 to connect the upper horizontal frame member 7 to the vertical side member 10. Because the screw bosses 56 and 57 extend along the extrusion, the vertical side frame members 9, 10 can be cut to length at the installation site, yet still retain interconnectability with the upper horizontal frame member 7. Rear web 58 extends transversely to the main web 55, and includes a lip 59, with an adjacent groove 60 that removably retains the vertical trim 26 to extension 61. Vertical trim 26 includes an angled forward wall portion 53, and an inner sidewall 54 that extends substantially parallel to the main web 55 of the vertical side frame member 10. As described in more detail below, when vertical frame members 9 and 10 are used with a glass panel 160 that includes an expressway 163 (FIG. 1), a stanchion 164 having a C-shaped cross section is secured to the vertical frame members 9, 10 by self-drilling and/or tapping fasteners 167. An end cover 64 includes a pair of barbed extensions 65 which removably retain the end cover 64 along the side edge 69 of frame 6 if required at an end-of-run location. A pair of outwardly-extending flanges 66 of vertical frame member 10 support the end cover 64.

Retainer 36 retains the edge 77 of the glass sheet at a location that is directly adjacent the side edge 69 of the frame 6, and offset from the center of the panel frame 6 along a front face 71A of the side frame member 10. This arrangement allows the glass sheet 12 to extend across substantially the entire side of the frame 6, thereby providing a smooth, finished appearance. Furthermore, because the edge 34 of the glass sheet 12 is located directly adjacent the side edge 69 of the frame 6, when a pair of frames 6 are interconnected in a side-by-side arrangement, adjacent side edges 34 are located directly adjacent one another, thereby minimizing the width of the retainer 36 and related structure between the adjacent glass sheets 12. Accordingly, only a relatively narrow vertical structure (second leg 81 and extension 89 of retainer 36) is visible from the side of the glass partition 1. Still further, because the forward wall 53 of trim piece 26 is angled inwardly, the visibility of the cover 26 and side frame member 10 is reduced. In particular, when a viewer is at an angle relative to the glass partition, the angled back wall 53 minimizes the obstruction of the viewers line of sight. The vertical trim 26 is similarly retained at the opposite end by extension 61 and lip 63. Still further, covers 25 and 26 form a pocket around jack screws 13, 14. This arrangement permits a row of glass partitions 1 and/or 160 to be assembled and interconnected along adjacent side edges 69. The row of glass partitions can then be quickly leveled using a powered driver. Covers 25 and 26 are then snapped on to provide a finished appearance.

Vertical side frame member 10 includes a retainer channel 70 extending vertically along the front face 71A. Retainer channel 70 includes a base wall 72, and inner and outer sidewalls 73 and 74 extending therefrom to define a generally U-shaped cross section with an opening 75 opposite the base wall 72. An elongated resilient strip 76 is located directly adjacent an outer edge 77 of the inner sidewall 73. The elongated strip 76 is configured to abuttingly support the glass sheet 12. The outer sidewall 74 includes a lip 78 extending into the opening 75 of the retainer channel 70.

Figure 9:
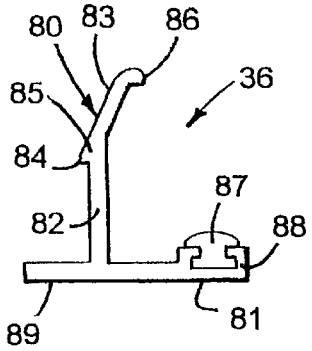
FIG. 9 is an end view of the retainer strip of FIG. 8.

With reference to FIG. 9, extruded aluminum retainer strip 36 has a generally L-shaped cross section defining a first leg 80, and a second leg 81. The first leg 80 has a base portion 82 and an end portion 83 extending therefrom at an obtuse angle relative to the base portion 82 to define a V-shape. The first leg 80 includes an extension 84 at the vertex 85 of the V-shape, such that upon insertion of the first leg 80 into the retainer channel 70, the edge 86 of the end portion 83 abuts the inner sidewall 73, and the extension 84 abuts the lip 78. The second leg 81 includes a resilient strip 87 adjacent the end portion 88 thereof that abuts the glass sheet adjacent the side edge 34 and generating a moment that is reacted by the first leg 80 to thereby releasably retain the edge 34 of the glass sheet 12. Extension 89 extends outwardly to the side edge 69 of frame 6, and provides a smooth external appearance at the junction with an adjacent glass panel. As discussed above, side edge 34 of glass sheet 12 is located immediately adjacent the outer face 68B of the side frame member 10, thereby maximizing the glass area along the front face 40 of the glass partition 1. Furthermore, glass sheet 12 is located immediately adjacent the front face 40 of the glass partition 1, thereby providing a smooth, uncluttered appearance. Channel 70 and retainer 36 provide an easily installed, secure glass capture having an aesthetically pleasing appearance that could be used for partial-height transparent panels and the like that do not extend across the entire floor-to-ceiling distance.

Figure 10:
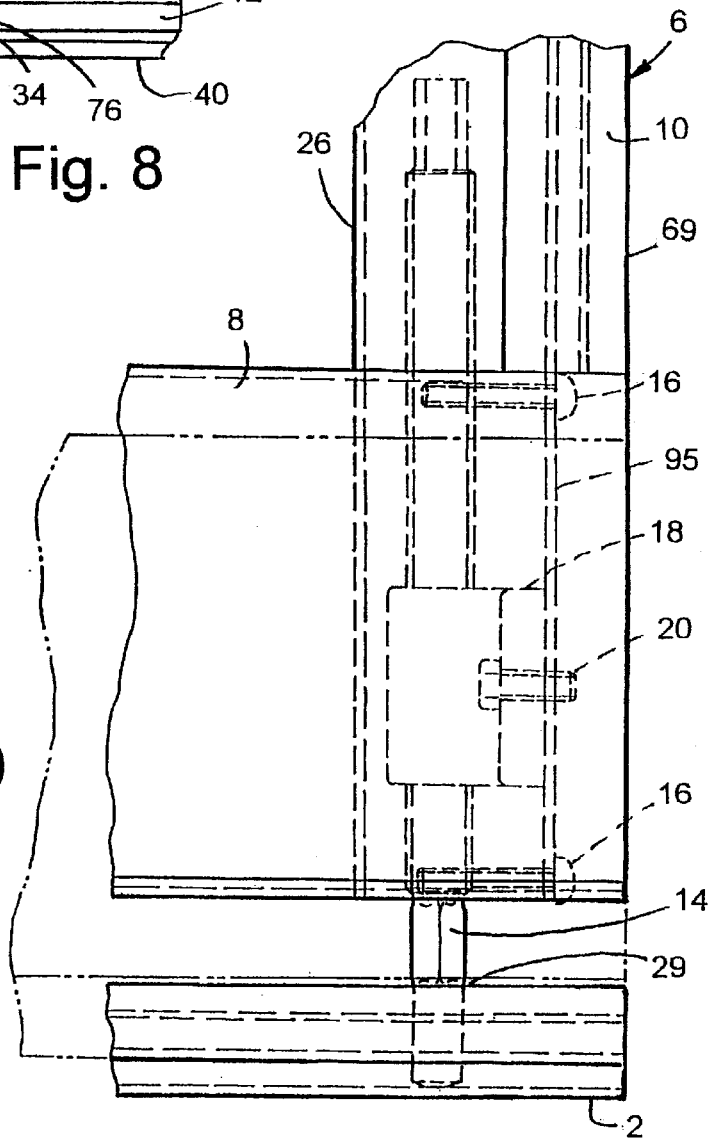
FIG. 10 is a fragmentary, front elevational view of the lower portion of the glass partition of FIG. 6.

With reference to FIGS. 10–12, threaded members 17 and 18 are attached to the side frame members 9 and 10 by fasteners 19 and 20. Upper and lower screw bosses 92 and 93 (FIG. 11) extend along lower horizontal frame member 8, and receive screws 16 to rigidly connect the side frame members 9 and 10 to the opposite ends 94 and 95 of the lower horizontal frame member 8. Cut-outs 96 and 97 (FIG. 2) in the upper surface 23 of lower horizontal frame member 8 provide clearance for the rear web 58 of the vertical side frame members 9 and 10. When assembled, vertical trim 25, 26 cover jack screws 13, 14. During assembly of the glass module, panel frame 6 and adjacent panel frames can be vertically adjusted using jack screws 13, 14. Trim 25, 26 is then placed over jack screws 13, 14 to provide a finished appearance.

As best seen in FIGS. 11 and 12, in the preferred embodiment, floor track 2 includes a center portion 98 having a generally rectangular cross-sectional shape with a pair of smaller rectangular portions extending along the sides thereof. The lower surface 100 of the floor track 2 abuttingly supports the track 2 on a floor surface 3. Floor track 2 includes upwardly-extending front and rear flanges 101 and 102 that receive front and rear base trim pieces 103 and 104. Base trim pieces 103 and 104 have lower portions with clips 105 and 106 to removably retain the base trim pieces 103, 104 in a vertical orientation with the upper, inner edges 107 and 108 abutting the front and rear side faces 109, 110 of lower horizontal frame member 8. This arrangement permits the jack screws 13 and 14 to be raised and/or lowered as required to compensate for floor surfaces 3 that are not level, while maintaining an acoustic barrier and a consistent appearance.

With reference to FIGS. 13 and 14, ceiling track 4 includes upper surfaces 115, and is shaped to be supported on the ceiling surface 5. Front and rear walls or webs 116 and 117 extend downwardly, forming front side face 46, and rear, or opposite side face 51. A pair of inner flanges 118 and 119 extend downwardly, and are interconnected by web 120 which is offset downwardly to form channel 123. The inner surfaces 121 and 122 taper inwardly to the upper surfaces 115. Upper horizontal frame member 7 includes an upwardly-extending flange portion 125 with an inwardly-extending end portion 126 having a retainer groove 127 at the end thereof that retains a resilient sealer strip 128. The retainer 48 includes a groove 129 with sealer strip 130 retained therein abutting rear side face 51 of ceiling track 41 when in an assembled condition. Retainer 48 includes vertically-oriented web 131, from which a downwardly-extending flange 132 projects. When in the installed condition, flange 132 fits over end 133 of upwardly-extending rear flange 134 of upper horizontal frame member 7, and a threaded fastener such as self-tapping screw 49 secures the retainer strip 48 to opening 52 in rear flange 134. The upper horizontal trim piece 50 includes a lower flange or clip 136 that is received on lip 135 of upper horizontal frame member 7, and an upper bead or protrusion 138 that is received within groove 137 of retainer strip 48 to thereby removably retain the trim piece 50. Retainer strip 48 and trim piece 50 together provide a outer surface that is substantially a mirror image of the upwardly-extending flange 125 along the forward side of the horizontal frame member 7.

During assembly, the lower edge of the assembled panel frame 6 may be placed on the floor track 2, and the upper portion of the panel frame 6 can then be rotated in the direction of the arrow "A" (FIG. 14), until the sealer strip 128 on upwardly-extending flange 125 abuts the front side face 46 of the ceiling track 4. The retainer strip 48 is then secured to the upper horizontal frame member 7 using fasteners 49, such that the sealer strip 130 of retainer strip 48 abuts the opposite side face 51 of the ceiling track 4, thereby retaining the panel frame 6 in a vertical orientation between floor track 2 and ceiling track 4. The trim piece 50 is then installed to provide a uniform, finished appearance.

With reference to FIG. 14, the upper horizontal frame member 7 includes a downwardly-opening U-shaped channel 37 directly adjacent the front side face 140. A pair of resilient sealer strips 141 support the upper edge 32 of glass sheet 12. The downwardly-extending forward flange portion 145 of upper horizontal frame member 7 forms an outer sidewall of the channel 37, such that glass sheet 12 is positioned immediately adjacent the front side face 140 of the horizontal frame member 7. Similarly, as best seen in FIG. 11, the upwardly-extending flange portion 146 of base cover 24 forms the outer wall of upwardly-opening U-shaped channel 30 when the base cover 24 is installed on lower horizontal frame member 8. Base cover 24 includes an upper inwardly-extending leg 151 that forms a base wall of the upwardly-opening channel 30. Upper and lower legs 151 and 152 each have a lip 147, 149 at the end thereof that are received in grooves 148 and 150, respectively of lower horizontal frame member 8 to thereby removably retain the base cover 24. A resilient strip 153 supports the lower edge 31 of glass sheet 12. Because the weight of glass sheet 12 acts downwardly on base cover 24, the base cover 24 is retained in upper and lower grooves 148 and 150 of lower horizontal frame member 8.

Figure 15:
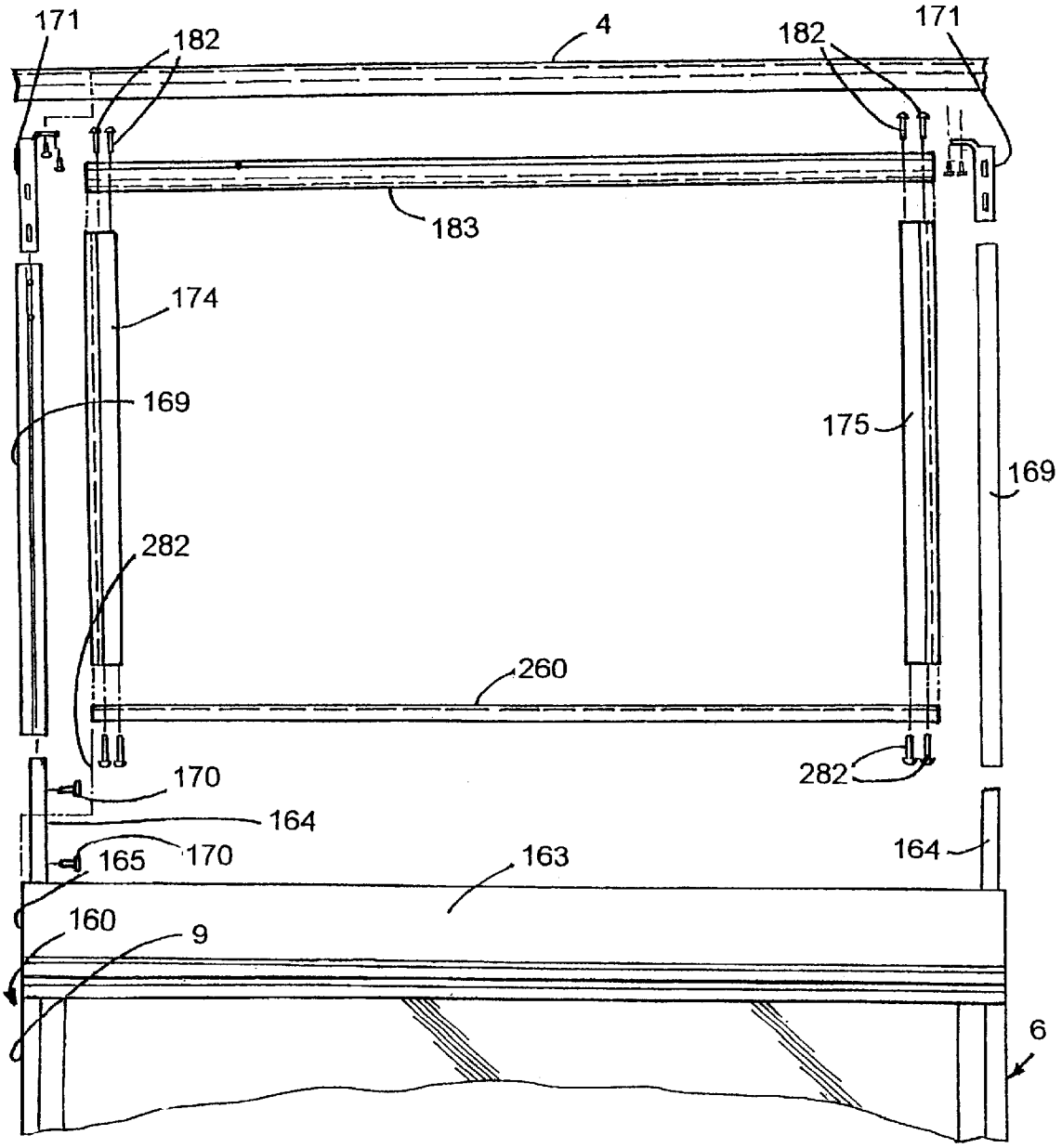
FIG. 15 is a fragmentary, exploded view of the top portion of a glass partition that includes an expressway and an upper glass module or upper cover panels.

With reference to FIG. 1, the glass partition may also comprise a glass panel 160 having a horizontally-extending overhead expressway 163 for routing of utility lines and the like. The partial height glass panels 160 may have an upper portion above expressway 163 that is covered with skins 161, or a glass module 162. With further reference to FIG. 15, a glass panel 160 includes upwardly-extending stanchions 164 at opposite ends 165 and 166 of the horizontal expressway 163. As described in more detail below, the stanchions 164 have a C-shaped cross section, and are fastened to the vertical side frame members 9, 10 of the panel frame 6 by fasteners 167 (see also FIG. 8). A structural extension 169 fits over stanchion 164, and is fastened thereto by fasteners 170. An upper bracket 171 fits inside the structural extension 169 (see also FIG. 16), and connects the glass panel 160 to the ceiling track 4. Slots 172 receive fasteners 170 to slidably interconnect bracket 171 and structural extension 169 to thereby permit the height of the panel 160 to be adjusted to account for variations in the floor-to-ceiling height.

Figure 18:
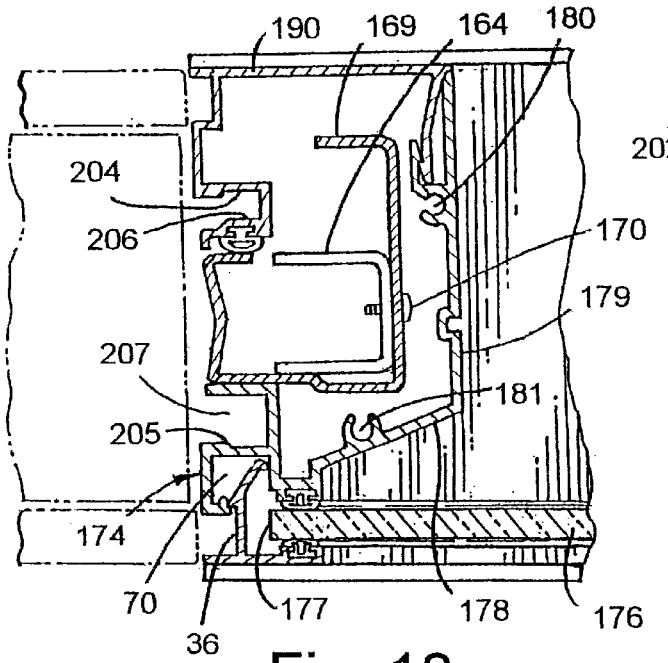
FIG. 18 is a cross-sectional view of the glass module taken along the line XVIII—XVIII, FIG. 17.
Figure 19:
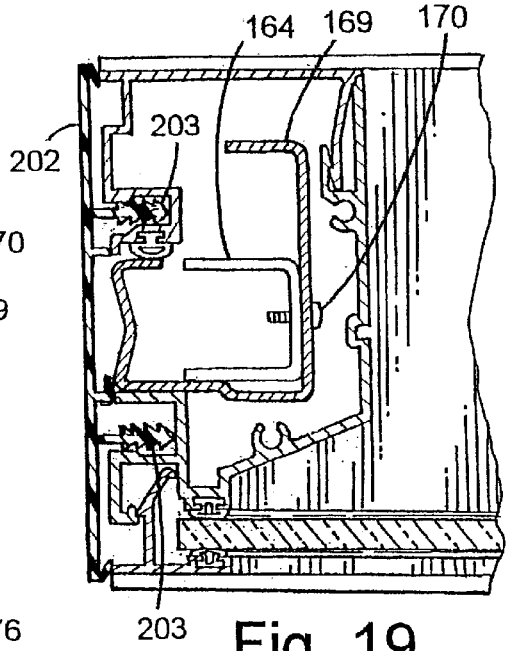
FIG. 19 is a cross-sectional view of the glass module of FIG. 18 showing an end trim cap.
Figure 20:
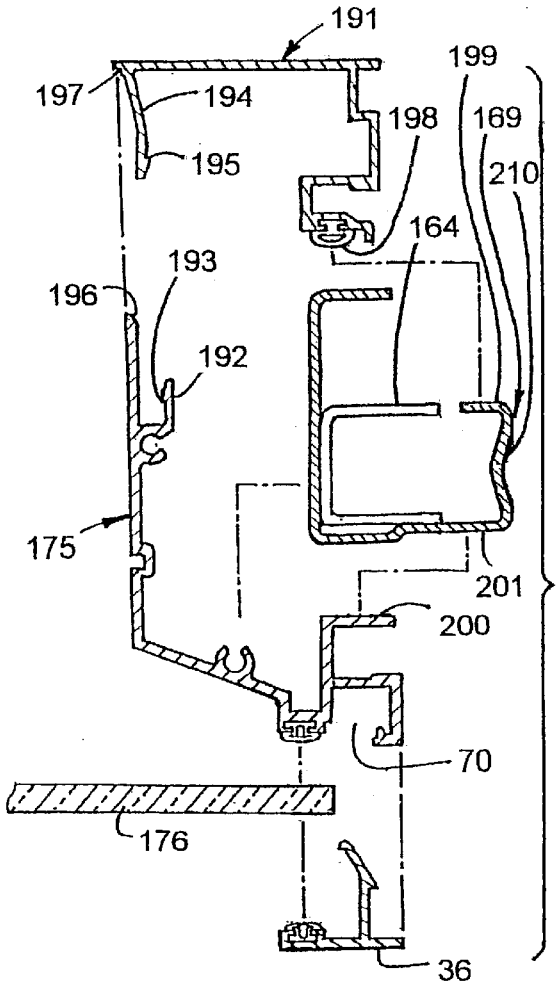
FIG. 20 is an exploded, cross-sectional view of the glass module of FIG. 18.

With reference to FIG. 18, the glass module 162 includes vertical side members 174 and 175 which may comprise aluminum extruded members or other suitable material. Vertical side member 174 includes a retainer channel 70 having substantially the same configuration as the retainer channel 70 of vertical side frame members 9 and 10 described in detail above. An L-shaped retainer strip 36 is removably received within the retainer channel 70 to retain the upper glass sheet 176 along the side edge 177. Vertical side member 174 includes inwardly-extending first and second leg portions 178 and 179 which cover the stanchion 164 and structural extension 169, as well as the lower portion of bracket 171. The legs 178 and 179 have substantially the same contour as the vertical trim pieces 26 to provide a uniform appearance. Screw bosses 180 and 181 receive fasteners 182 (see also FIG. 15) to secure the horizontal upper glass module frame member 183 to the vertical side members 174 and 175. With further reference to FIG. 20, the vertical side members 174 and 175 removably receive a rear vertical trim piece 190, 191. The vertical trim piece 191 includes an extension 194 having a barb 195 adjacent the end thereof that is configured to engage the barb 193 of flange 192 of the vertical side member 175. The edge 196 of the vertical side member 175 abuts the groove 197 of the rear vertical trim piece 191 upon engagement of the barbs 193 and 195, thereby generating a moment that causes the resilient strip at the end 198 of the rear vertical trim piece 191 to snugly abut the inwardly-extending flange 199 of the G-shaped structural extension 169. When in the installed position, the inner flange 200 of the vertical side member 175 abuts the outer surface 201 of the structural extension 169. As illustrated in FIG. 19, a polymer end cap 202 includes a pair of barbed extensions 203 that engage the ridges 204 and 205 of channels 206 and 207.

Figure 21:
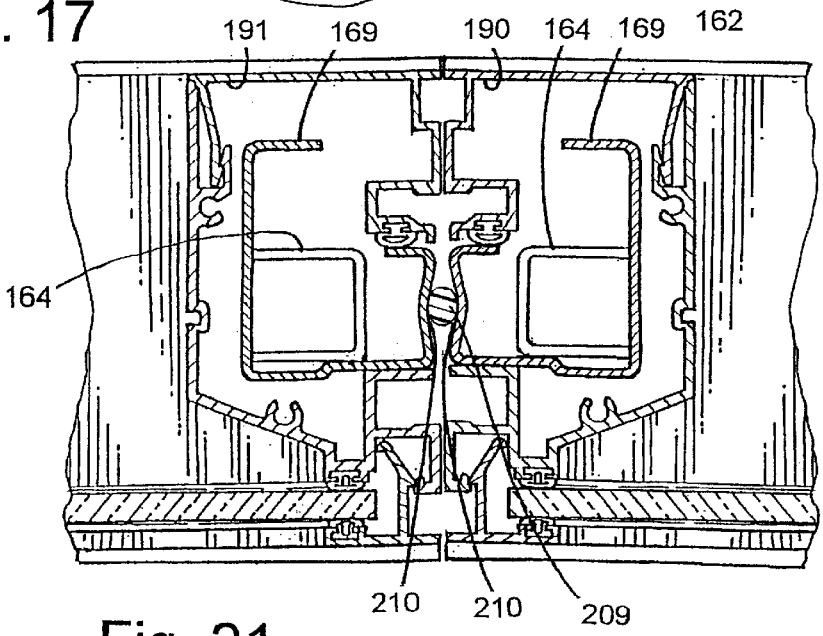
FIG. 21 is a cross-sectional view of the glass module taken along the line XXI—XXI, FIG. 17.

With reference to FIG. 21, adjacent glass module frames have an elongated elastomeric seal 209 that is received in the opposing channels of the structural extensions 169. However, the adjacent glass module panel frames are not otherwise interconnected.

Figure 22:
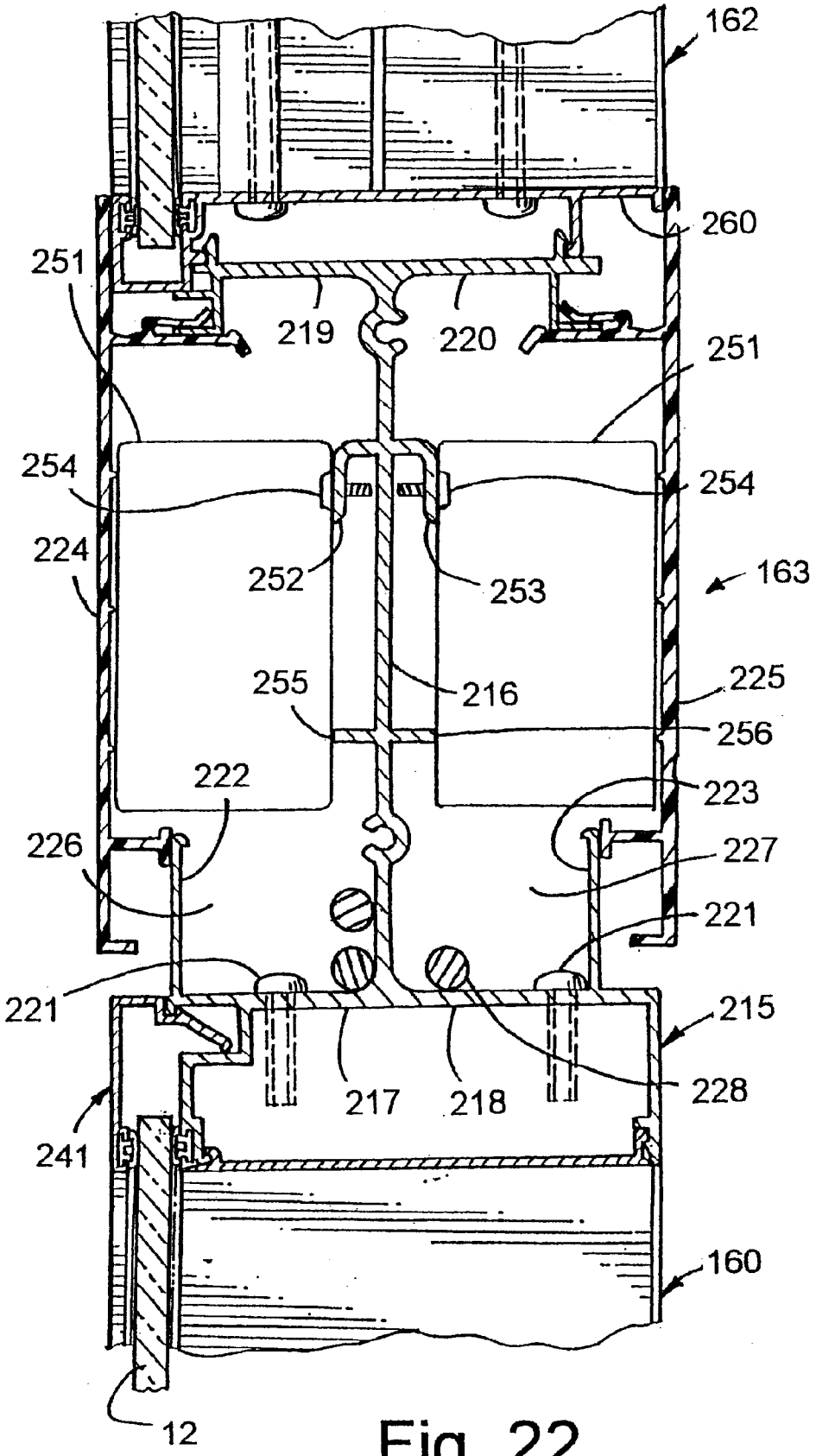
FIG. 22 is a cross-sectional view of the expressway taken along the line XXII—XXII, FIG. 17.
Figure 23:
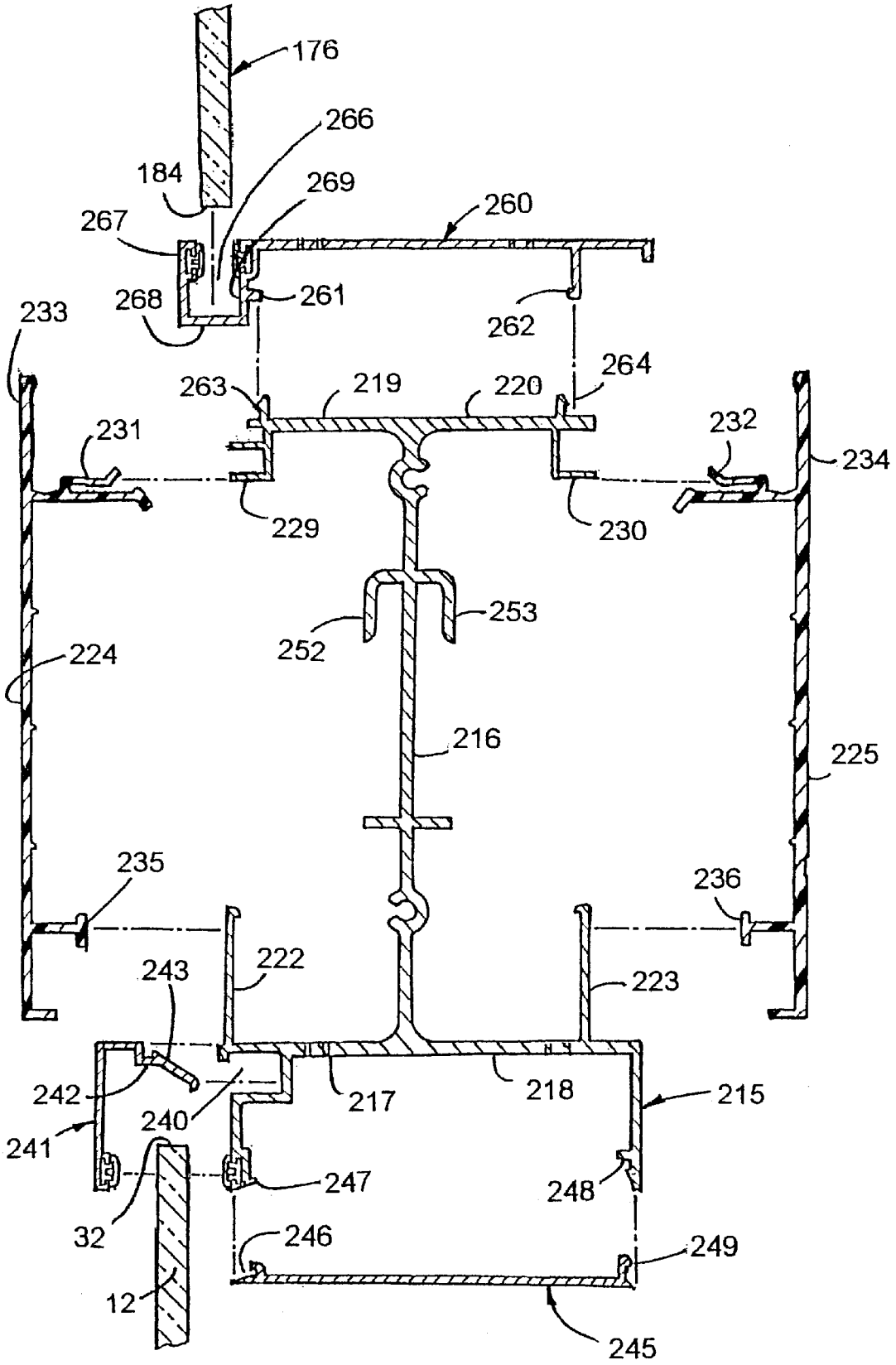
FIG. 23 is an exploded view of the expressway of FIG. 22.

With reference to FIGS. 22 and 23, a horizontal expressway 163 includes an aluminum extrusion 215 that has a generally I-shaped cross section with a vertically-extending center web 216, lower horizontal flanges 217 and 218, and upper horizontal flanges 219 and 220. Fasteners 221 extend downwardly through the flanges 217 and 218 to secure the horizontal expressway member 215 to the screw bosses 56 and 57 of the vertical side frame members 9, 10. Front and rear upwardly-extending flanges 222 and 223 abut the front and rear expressway covers 224 and 225 for support thereof, and also define upwardly-opening U-shaped channels 226 that are shaped to receive and support lay-in power and communications lines 228. Front and rear expressway covers 224, 225 are made of a polymeric material, and include clips 231, 232 extending inwardly adjacent the upper portions 233. The clips 231 and 232 removably connect the covers 224 and 225 to the sidewardly-extending flanges 229 and 230 of the horizontal expressway member 215. Extensions 235 and 236 of the front and rear covers 224, 225 abut the flanges 222, 223, respectively.

Flanges 252 and 253 extend outwardly and downwardly from the center web 216, and receive fasteners 254 for mounting electrical junction boxes 251. Front and rear extensions 255, 256 are configured to abuttingly support the lower portion of the junction boxes 251.

As best seen in FIG. 23, the horizontal expressway member 215 includes a horizontally-extending channel 240 that has substantially the same configuration as the retainer channel 70 of the vertical frame member 10. Horizontal retainer strip 241 includes first and second legs 242 and 243 that retain the horizontal retainer strip 241 in the channel 240 in substantially the same manner as the retainer strip 36 described above. Accordingly, upper edge 32 of glass sheet 12 is retained in substantially the same manner as the opposite side edges 33 and 34 of the glass sheet 12. However, expressway member 215 could include a downwardly-opening channel having substantially the same configuration as channel 37 of upper horizontal frame member 7 (FIG. 14), such that upper edge 32 of glass sheet 12 is retained by expressway member 215 in substantially the same manner as illustrated in FIGS. 13–14. Lower trim strip 245 includes a front groove 246 that receives lip 247, and rear lip 249 is received in groove 248 to removably retain the trim piece 245 to the horizontal expressway member 215.

Lower horizontal frame member 260 includes a forward lip 261 and rear lip 262 that removably connect the frame member 260 to the front and rear barbs 263, 264, respectively, of the horizontal expressway member 215. Frame member 260 includes an upwardly-opening U-shaped channel 266 defined by an upwardly-extending front side flange 267, a base wall or flange 268, and an inner sidewall or flange 269. Lower edge 184 of upper glass sheet 176 is received within the channel 266 when in an installed position.

Figure 24:
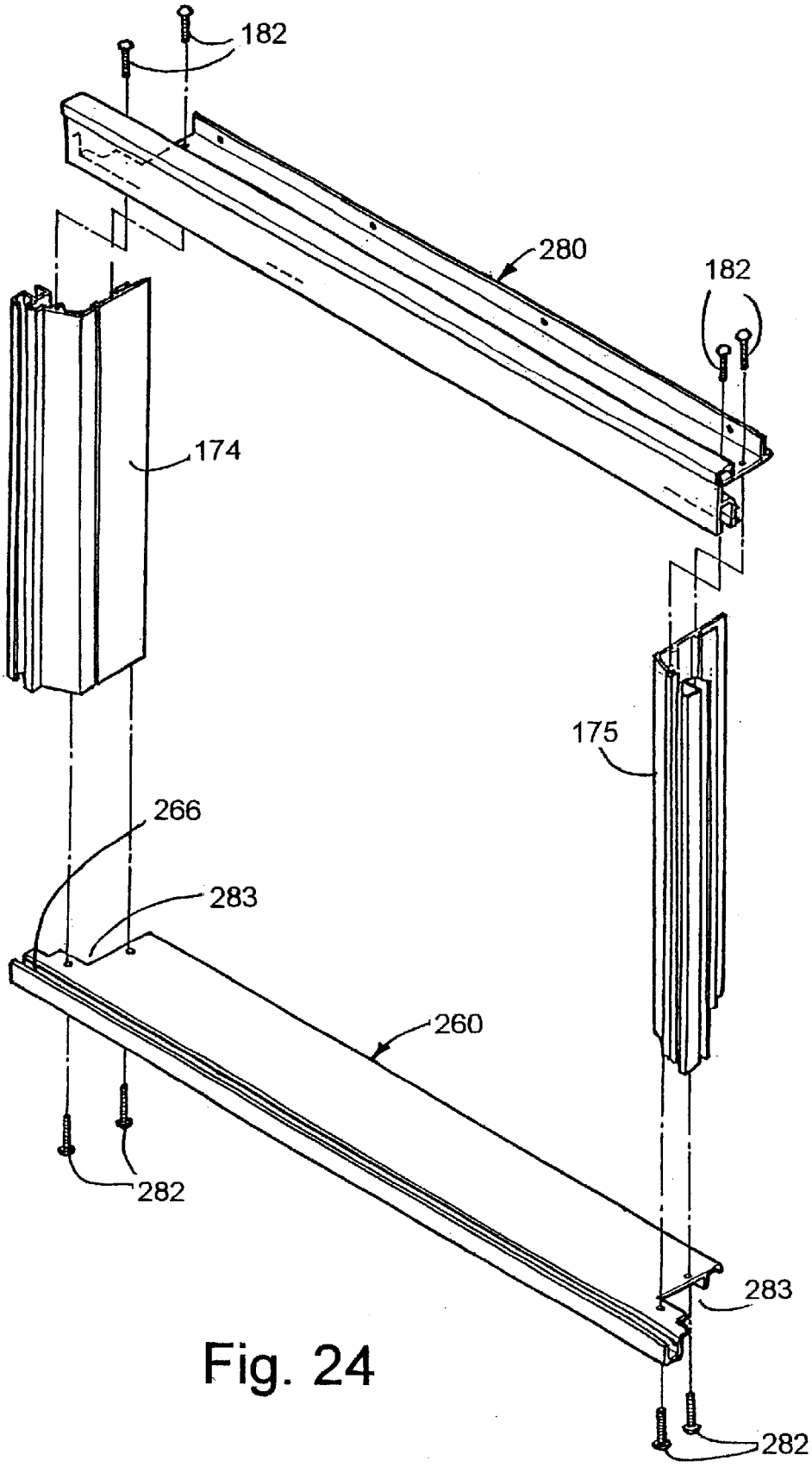
FIG. 24 is an exploded perspective view of the glass module frame.
Figure 25:
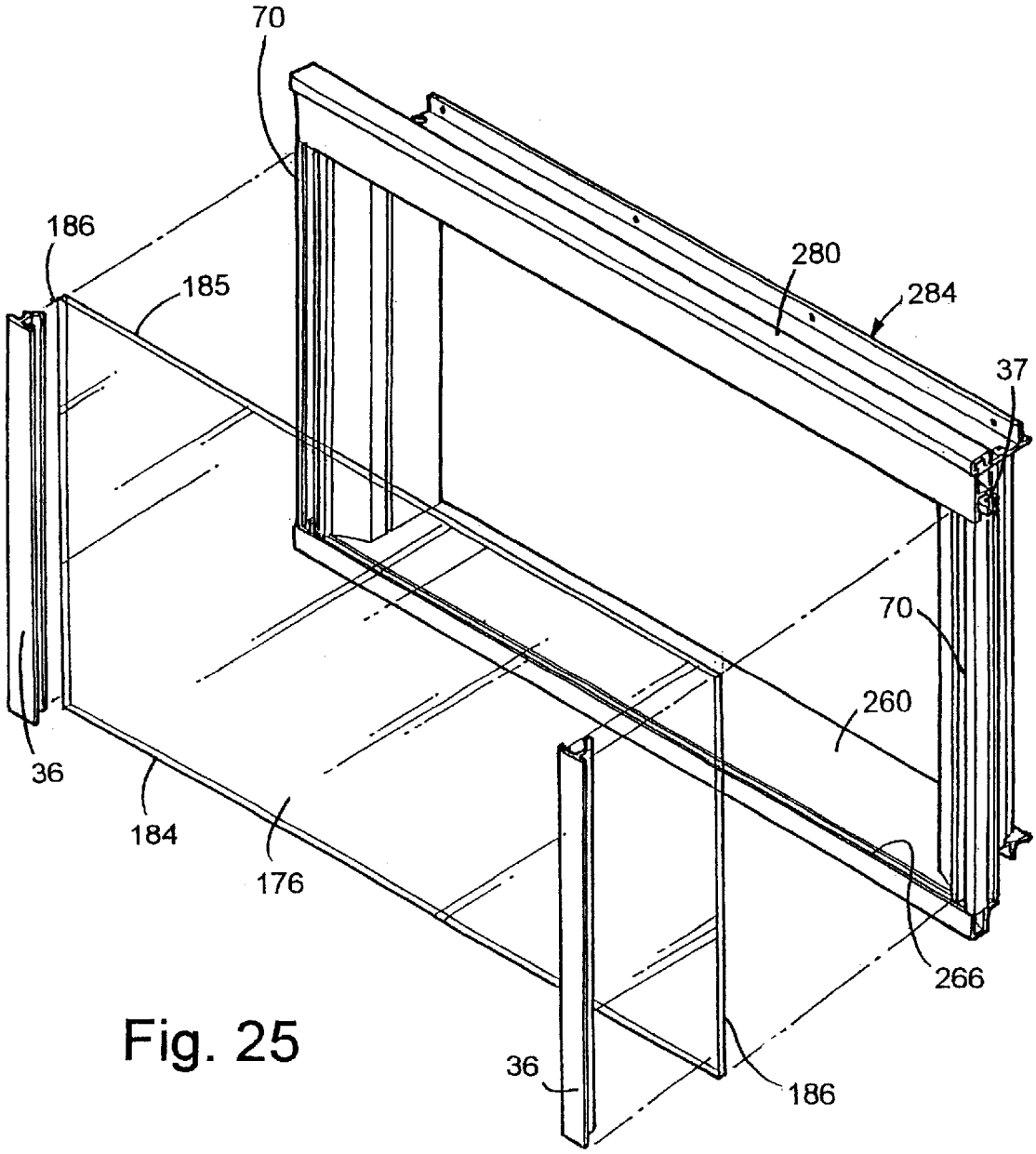
FIG. 25 is a perspective view of the glass module showing installation of the retainer strips and glass.
Figure 26:
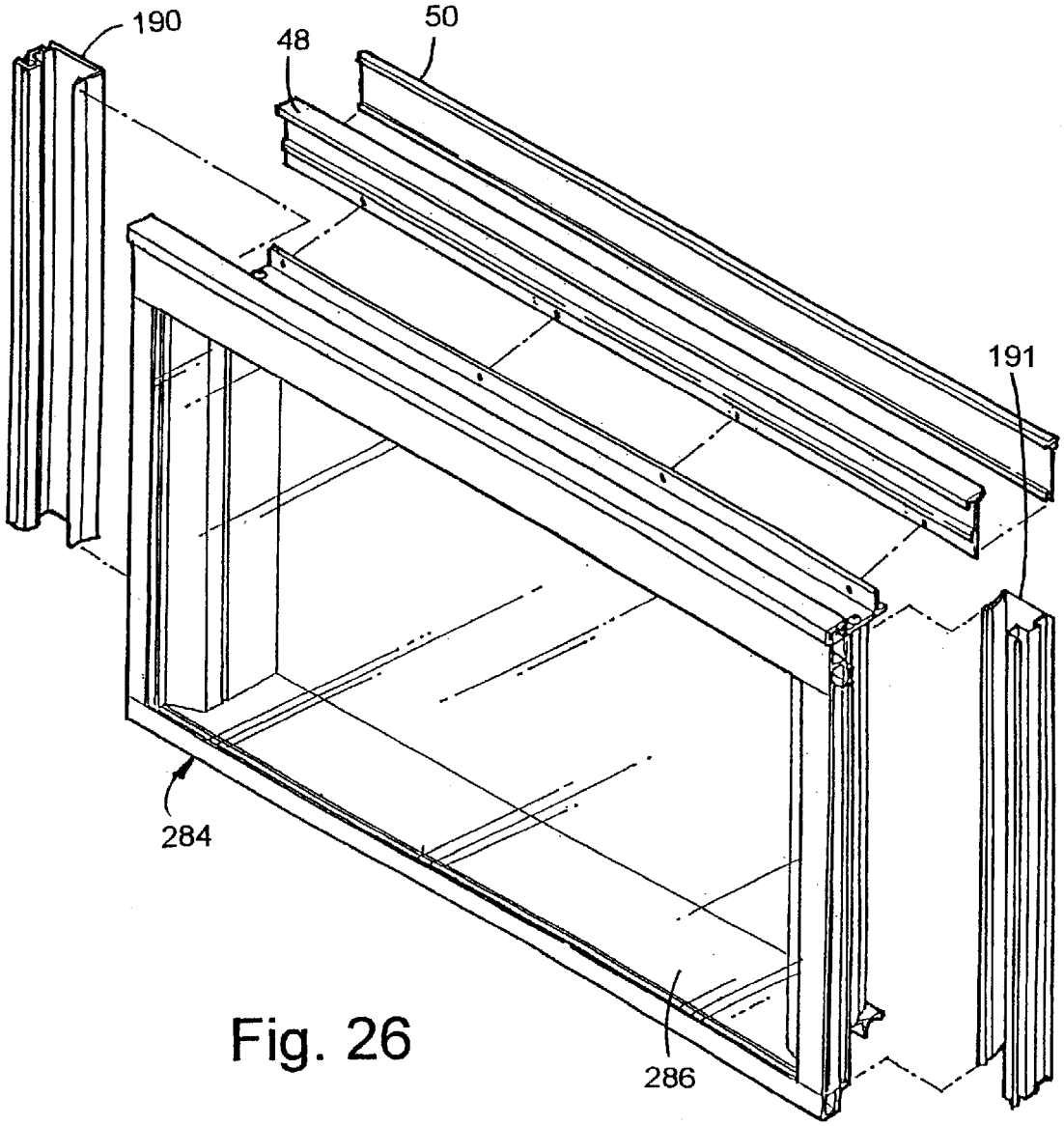
FIG. 26 is a perspective view of the glass module showing installation of the rear trim pieces and retainer.
Figure 27:
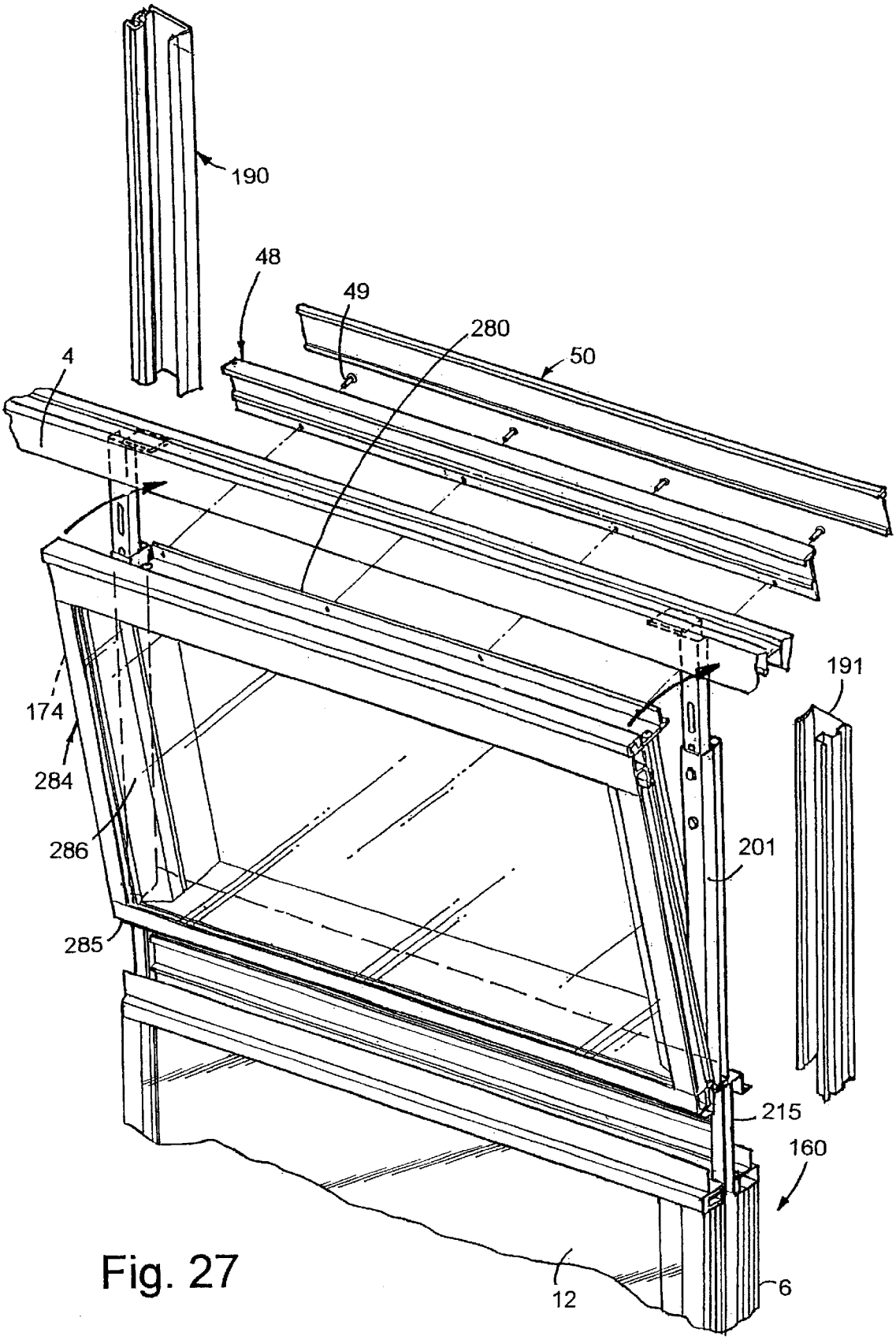
FIG. 27 is a fragmentary perspective view showing the installation of the glass module between the expressway and ceiling track.

With reference to FIG. 24, during assembly of glass module frame 284, upper horizontal frame member 183 is attached to the vertical side members 174 and 175 by fasteners 182, and frame member 260 is connected to the vertical side members 174, 175 by fasteners 282. The frame member 260 is cut-out at opposite ends thereof at 283 to provide clearance for the stanchions 164, structural extensions 169, and bracket 171 which fit behind the vertical side members 174 and 175. With reference to FIG. 25, upper horizontal frame member 280 has substantially the same cross-sectional shape as upper horizontal frame member 7 (see FIGS. 13, 14), and includes a downwardly-opening U-shaped channel 37. Glass sheet 176 is installed by inserting the upper edge 185 thereof into the channel 37. The lower edge 184 of the glass sheet 176 is then placed in the channel 266, and retainer strips 36 are inserted into channels 70 to retain the side edges 186 of the glass sheet 176 to glass module frame 284. With further reference to FIGS. 26 and 27, the glass module 286 is installed to the partial height glass panel 160 by placing the lower edge 285 of the frame 284 on the horizontal expressway member 215. The glass module 286 is then rotated upwardly until the flange 200 of vertical side members 174 and 175 contacts the outer surface 201 of structural extensions 169 (see also FIG. 20). The vertical trim pieces 190 and 191 are then connected to the vertical side frame members 174 and 175, and the retainer strip 48 is fastened to the frame member 280 with fasteners 49. Trim piece 50 is then installed to retainer 48 to cover the fasteners 49. When the glass module 286 is in the installed position, the upper frame member 280 and retainer strip 48 retain the glass module 286 in substantially the same manner as described above with respect to the full-height glass module (FIG. 13).

Figure 28:
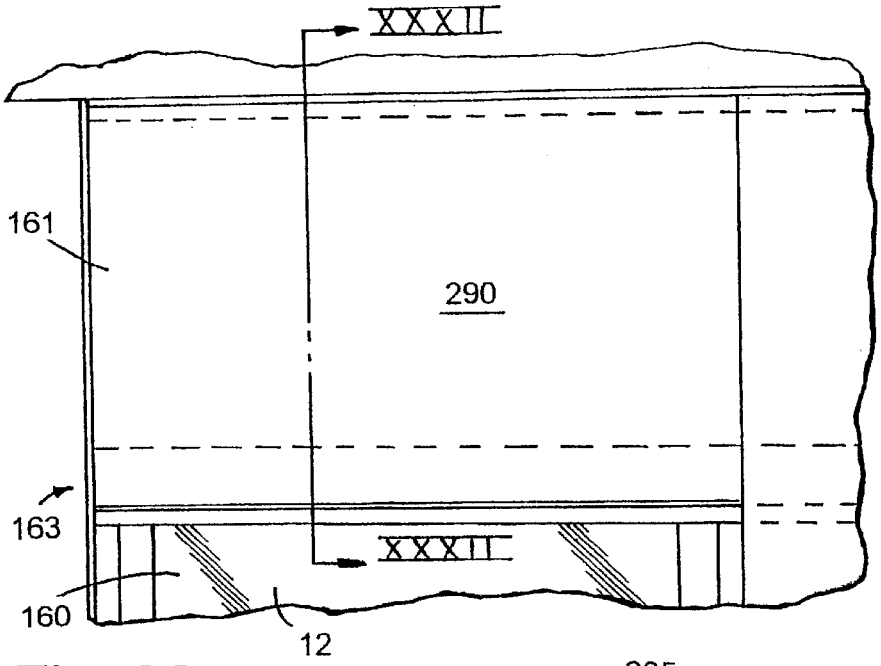
FIG. 28 is a fragmentary view of a cover panel used above an expressway of a glass partition.
Figure 29:
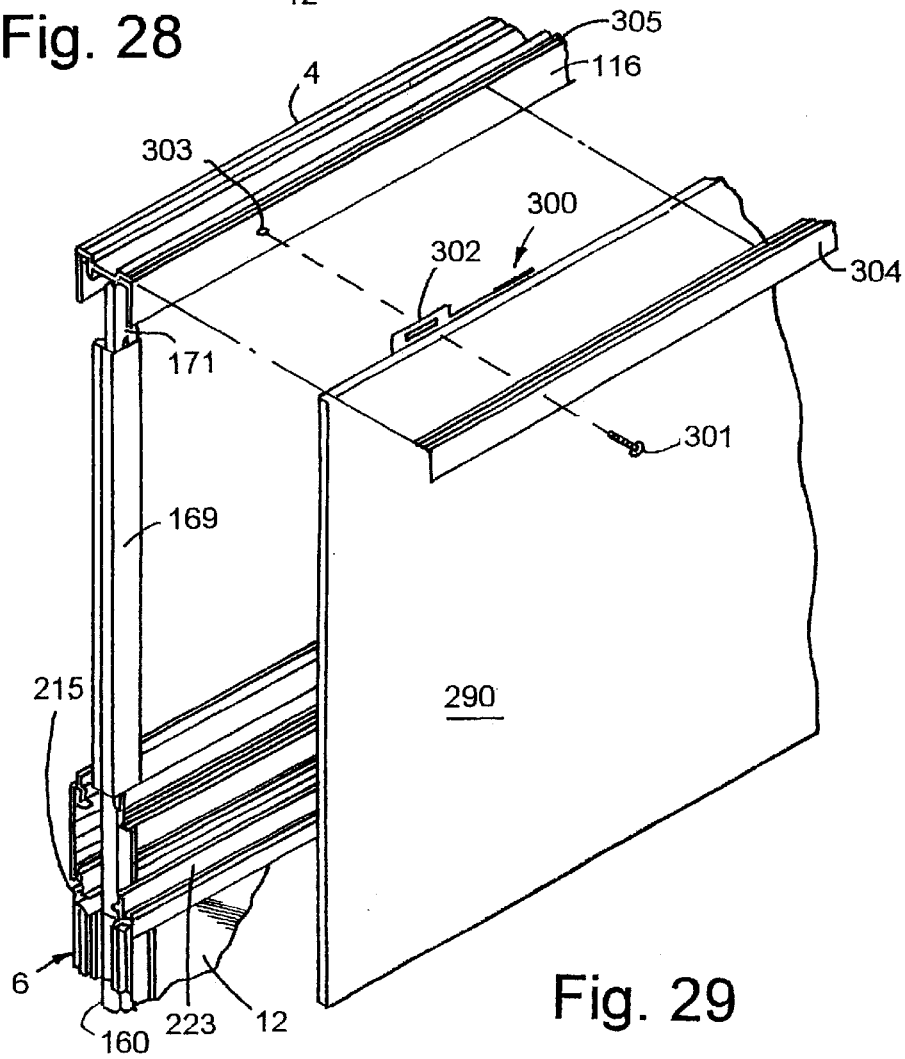
FIG. 29 is a fragmentary, perspective view showing the installation of the cover panel of FIG. 28.

With reference to FIG. 28, a transom, or covered upper structure may be utilized above a glass panel 160. With further reference to FIG. 29, a cover panel 290 includes a downwardly-extending hook-shaped flange 254 along a lower edge that engages upwardly-extending flange 223 of horizontal expressway member 215. A connector 300 is attached to the upper edge of the cover panel 290, and receives a fastener 301 that is secured into a hole 303 in a side web or wall 116 of ceiling track 4 to thereby retain the upper edge of the cover panel 290 to the ceiling track 4. A cover 304 is removably received in a notched channel 305 in this embodiment of the ceiling track 4.

Figures 30, 31:
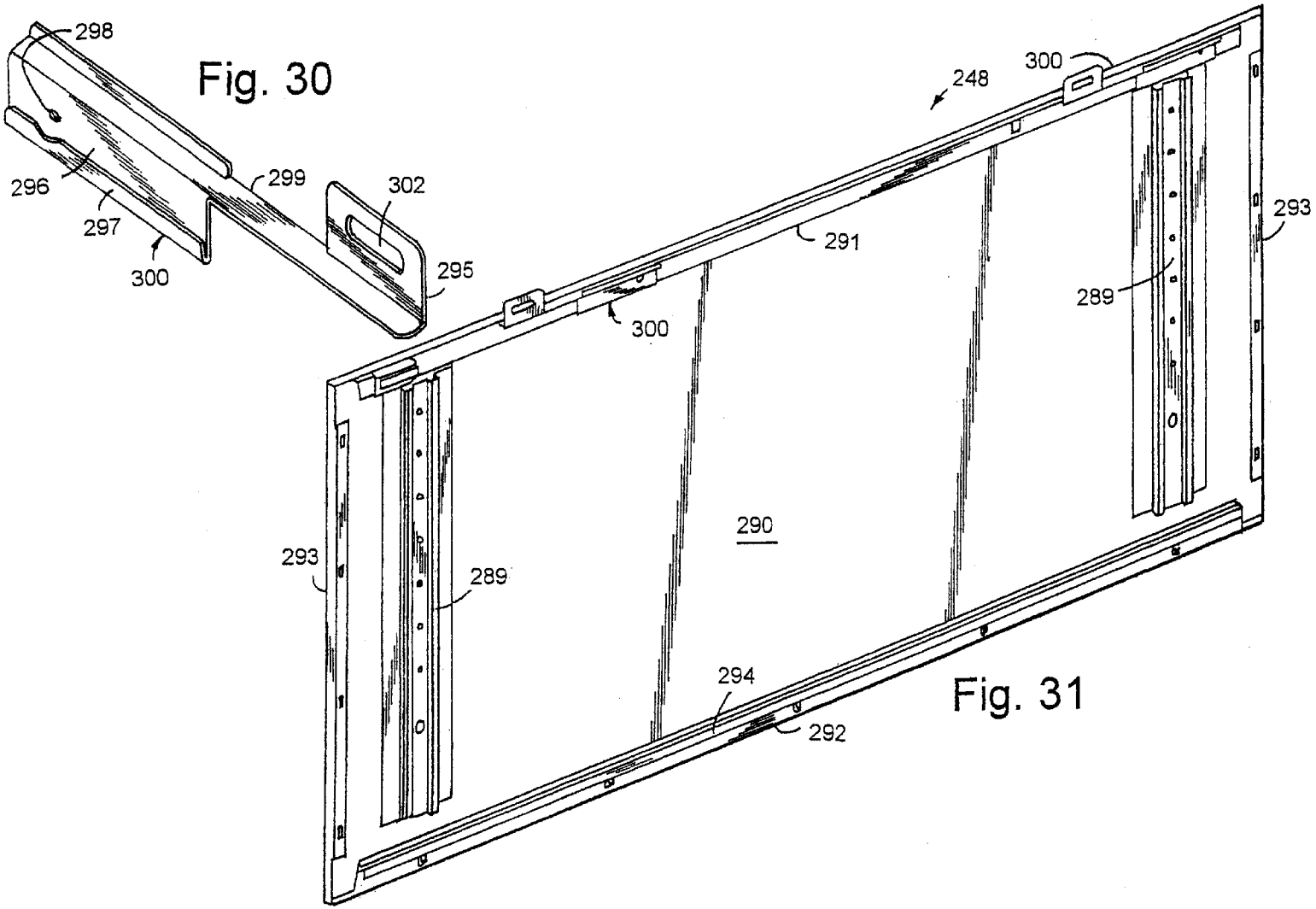
FIG. 30 is a perspective view of a connector used with the cover panel of FIG. 31.
FIG. 31 is a perspective view of the cover panel of FIG. 28.

With further reference to FIGS. 30 and 31, cover panel 290 has a metal frame or stiffener including a downwardly-extending upper flange 291 and an upwardly-extending lower flange 292 that includes a downwardly-extending hooked portion 294. Side flanges 293 extend along opposite sides of the cover panel 290, and stiffeners 289 may be secured adjacent the side edges if required. A connector 300 includes a web or wall portion 296 with an upturned, or bent-in end flange portion 297. A clearance hole 298 receives a rivet or other fastener to secure the connector 300 to the upper flange 291 of the cover panel 290. An extension 299 includes an upwardly-extending tab portion 295 with a slot, or opening 302 therein.

Figure 32:
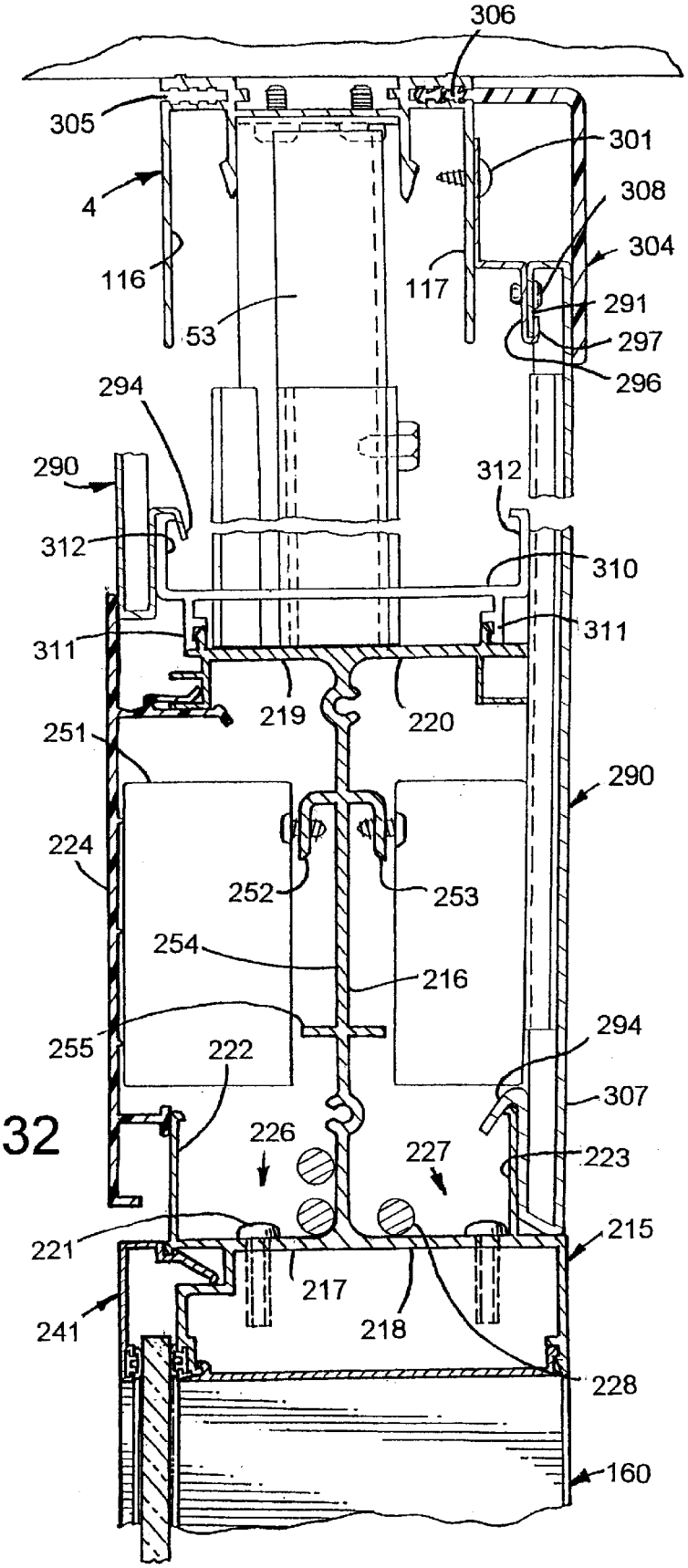
FIG. 32 is a cross-sectional view taken along the line XXXII—XXXII, FIG. 28.

With reference to FIG. 32, the hooked lower flange portion 294 supports the lower edge of the cover panel 290 on the upwardly-extending flange 223 of the expressway member 215. Cover panel 290 has a sheet metal skin 307 that forms upper flange 291. A rivet 308 or other fastener connects the cover panel flange 291 to the web 296 of connector 300, and fastener 301 secures the connector 300 to the sidewall 116 or 117 of ceiling track 4. The embodiment of the ceiling track 4 illustrated in FIG. 32 includes a notched channel 305 extending therealong that receives the barbed end 306 of a polymer cover 304 to thereby removably retain the cover 304 to the ceiling track 4. A cover panel support member 310 includes downwardly-extending connectors 311 that removably connect the support member 310 to the expressway member 215. When a cover panel 290 is used with an expressway cover 224, the lower flange 294 is supported on the side flange 312 of the support member 310, as also illustrated in FIG. 32.

Figure 33:
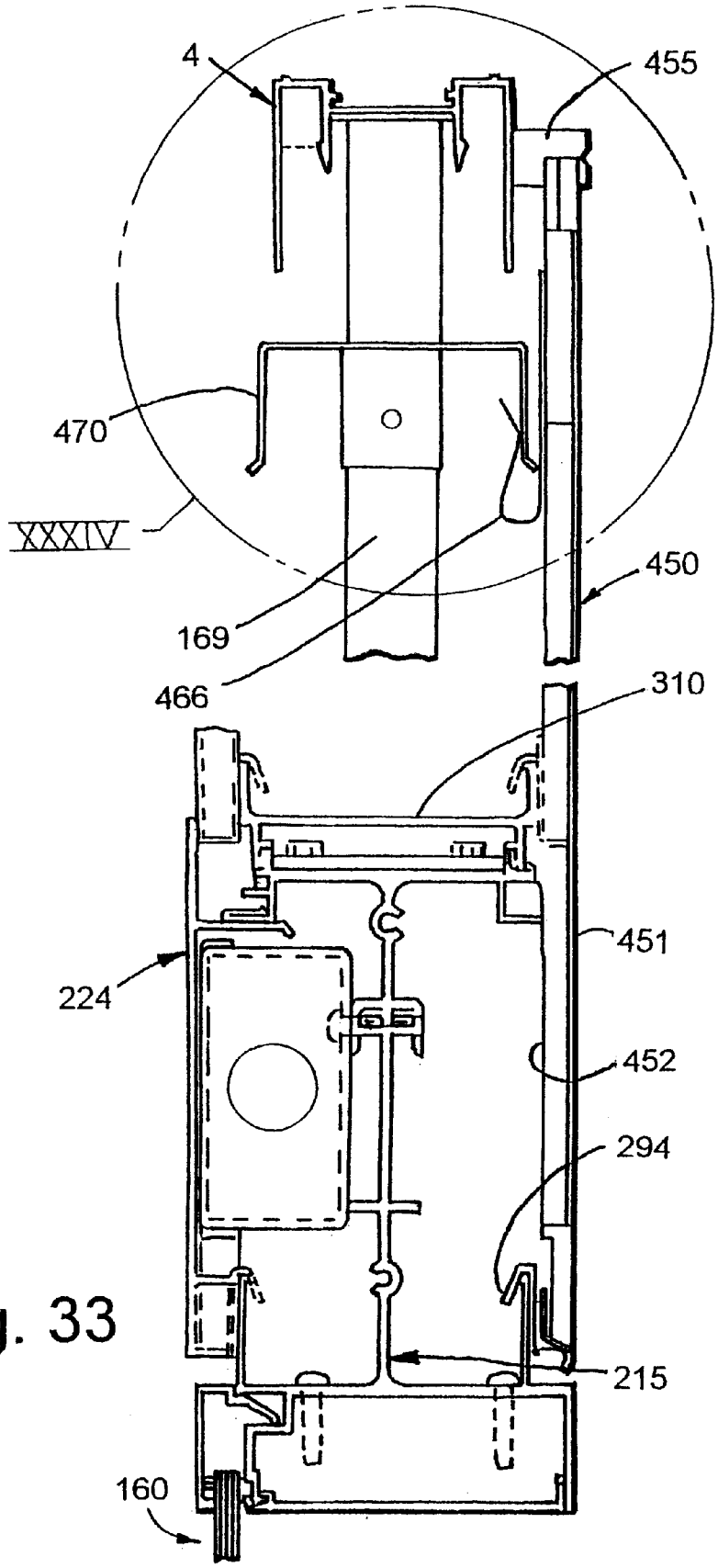
FIG. 33 is a fragmentary end view of another cover panel used above the expressway.
Figure 34:
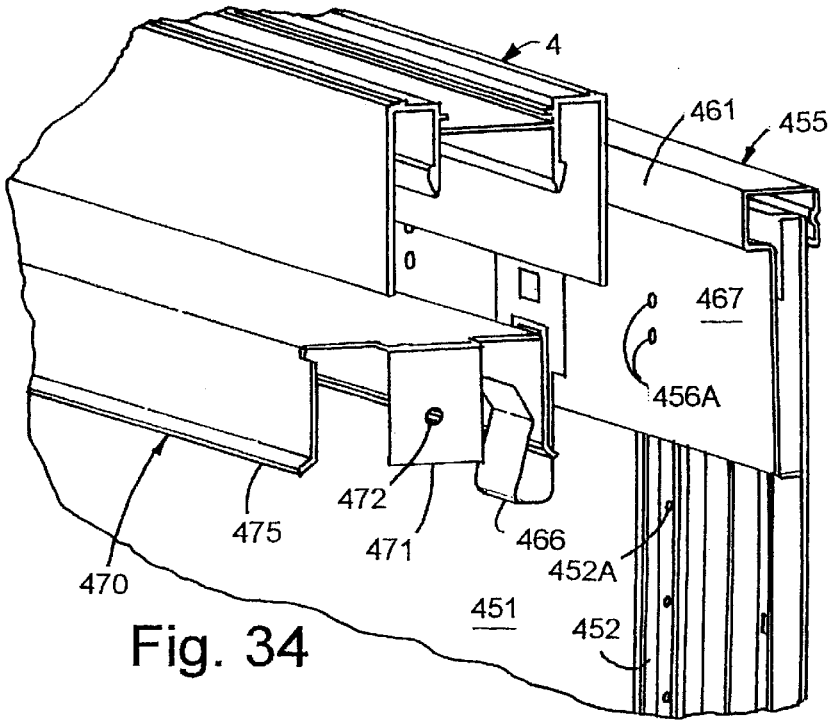
FIG. 34 is a fragmentary view of the cover panel of FIG. 33.
Figure 35:
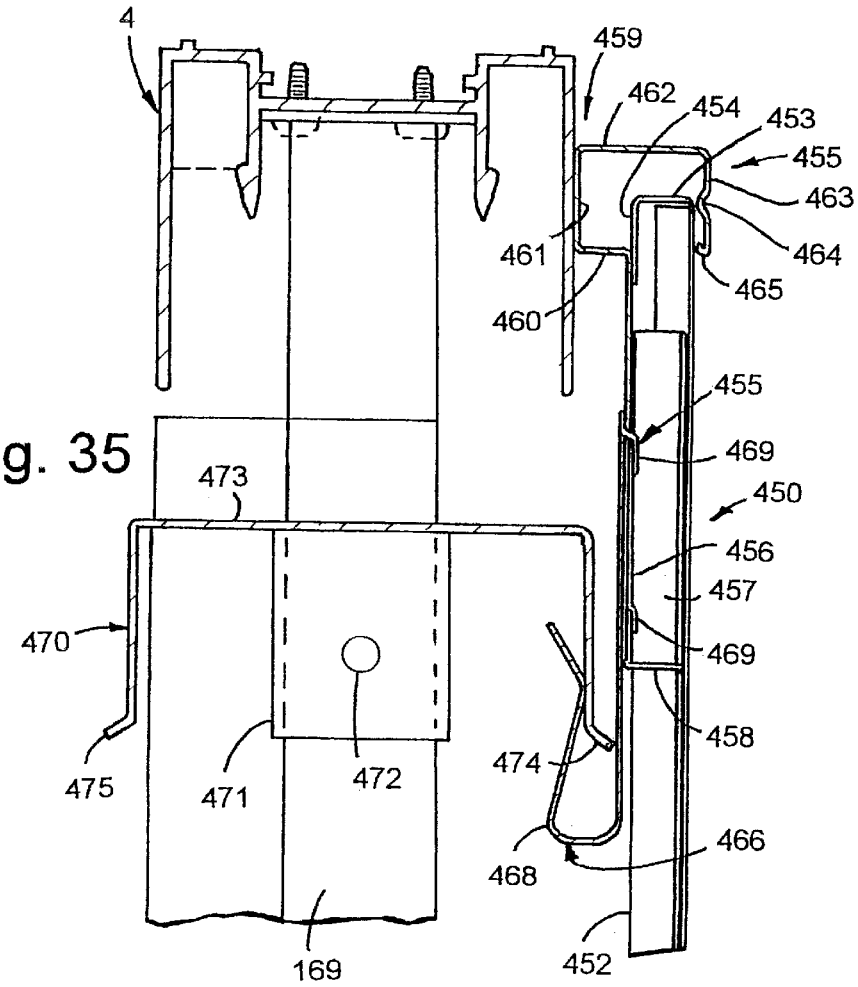
FIG. 35 is a fragmentary, perspective view of the cover panel of FIG. 33.

A modified upper cover 450 supported by a modified top connector arrangement is shown in FIGS. 33–35. Upper cover 450 includes a flat body 451 formed from sheet metal, composite material, or the like, and includes side edge stiffeners or side flanges 452. The top edge of the illustrated sheet metal body panel 451 is reversely bent to form a flat top section 453 and back flange 454. A top connector 455 for upper cover 450 includes a flat lower section 456 that extends parallel the body panel 451. Side and bottom flanges 457 or 458 are formed on or attached to lower section 456 to form a box-shaped platform that stably abuts a rear side of body panel 451. The lower section 456 is screwed into the edge stiffeners 452.

The upper section 459 of top connector 455 includes a rearwardly bent flange 460, a standoff flange 461 for abutting a side wall 65 of ceiling channel 54, and a forwardly bent flange 462. A down flange 463 extends from forwardly bent flange 462, and includes a radiused ridge 464 that provides a aesthetic line for appearance and that abuts a face of the body panel 451. A rearward curled lip 465 on down flange 463 hides any burrs or unevenness on curled lip 465 and further provides a grip for securely retaining any upholstery or vinyl covering on transom cover 450. The curled lip 465 also prevents such upholstery or fabric from unraveling, which unraveling can be a problem in field cut covers.

A J-shaped spring clip 466 includes an attachment leg 467 for attachment to lower section 456 and a resilient U-shaped lower leg 468. Attachment leg 467 includes tabs 469 configured and bent to securely engage the lower section 456 to secure the clip 466 to the top connector 455.

An adapter bracket 470 (FIG. 34) includes a lower end 471 shaped to matably engage the structural extension 169, and includes a tab hole 472 for screw attachment thereto. An inverted U-shaped section 473 extends from lower end 471 and includes arms with down flanges 474 and 475. Adapter bracket 470 is attached to structural extension 169 so that the down flange 474 (or 475) is engagable by the lower leg 468 of the J-shaped spring clip 466 when the transom cover 450 is installed. An adapter bracket 470 is attached to each structural extension 169.

To field cut the transom cover 450, the top connector 455 is removed by removing screws in holes 452A and 456A, and the upper edge of the cover 450 is then cut to a desired height. The top connector 455 is then reattached by extending the screws through holes 456A into a newly selected hole 452A in transom cover 450. The adapter brackets 470 are attached to the associated structural extensions 169 at a desired height. The transom cover 450 is then removably attached by extending spring clip 466 into mating engagement with down flange 474 of adapter brackets 470, and then by lowering the bottom hook connector 254 into engagement with up flange 86. Notably, the transom cover 450 can include a flexible light seal 477 at its bottom if desired for improved aesthetics.

During assembly of a full height glass partition, the frame 6 (FIG. 2) is assembled by securing the upper and lower horizontal frame members 7 and 8 to the vertical side frame members 9 and 10 with fasteners 15, 16. The frame 6 may then be placed over the floor track 2 (FIG. 3), and rotated into a vertical position wherein the sealer strip 128 of upwardly-extending flange 125 of upper horizontal frame member 7 abuts a side face of the ceiling track 4. Retainer 45 is then secured to the upper horizontal member 7 using fasteners 49, and trim piece 50 is installed over the retainer 48. Frame 6 is interconnected to adjacent panels using fasteners (not shown) that are received in clearance holes 27 in side frame members 9, 10. Clearance holes 27 may be formed during fabrication of the side frame members 9, 10. Alternatively, dimples or indentations may be provided, and the clearance holes 27 drilled as required during assembly. After the frame 6 is secured between the floor track 2 and the ceiling track 4, base cover 24 is installed on the lower horizontal frame member 8, and the upper edge 32 of glass sheet 12 is in the downwardly-opening U-channel 37 in upper horizontal frame member 7 (see also FIG. 14), and the lower edge 31 of glass sheet 12 is placed into the upwardly-opening U-shaped channel 30 of lower horizontal frame member 8 and base cover 24 (see also FIG. 11). Retainer strips 35 are then inserted into the retainer channel 70 of the vertical side frame members 9 and 10, and vertical trim pieces 25, 26 are attached to the vertical side members 9, 10. The exact sequence of steps could be varied if desired, and the above-described assembly sequence is not to be considered as limiting. The frame 6 (with glass 12) can be easily disconnected from the ceiling track and moved as a module if required to reconfigure the office space.

Figure 16:
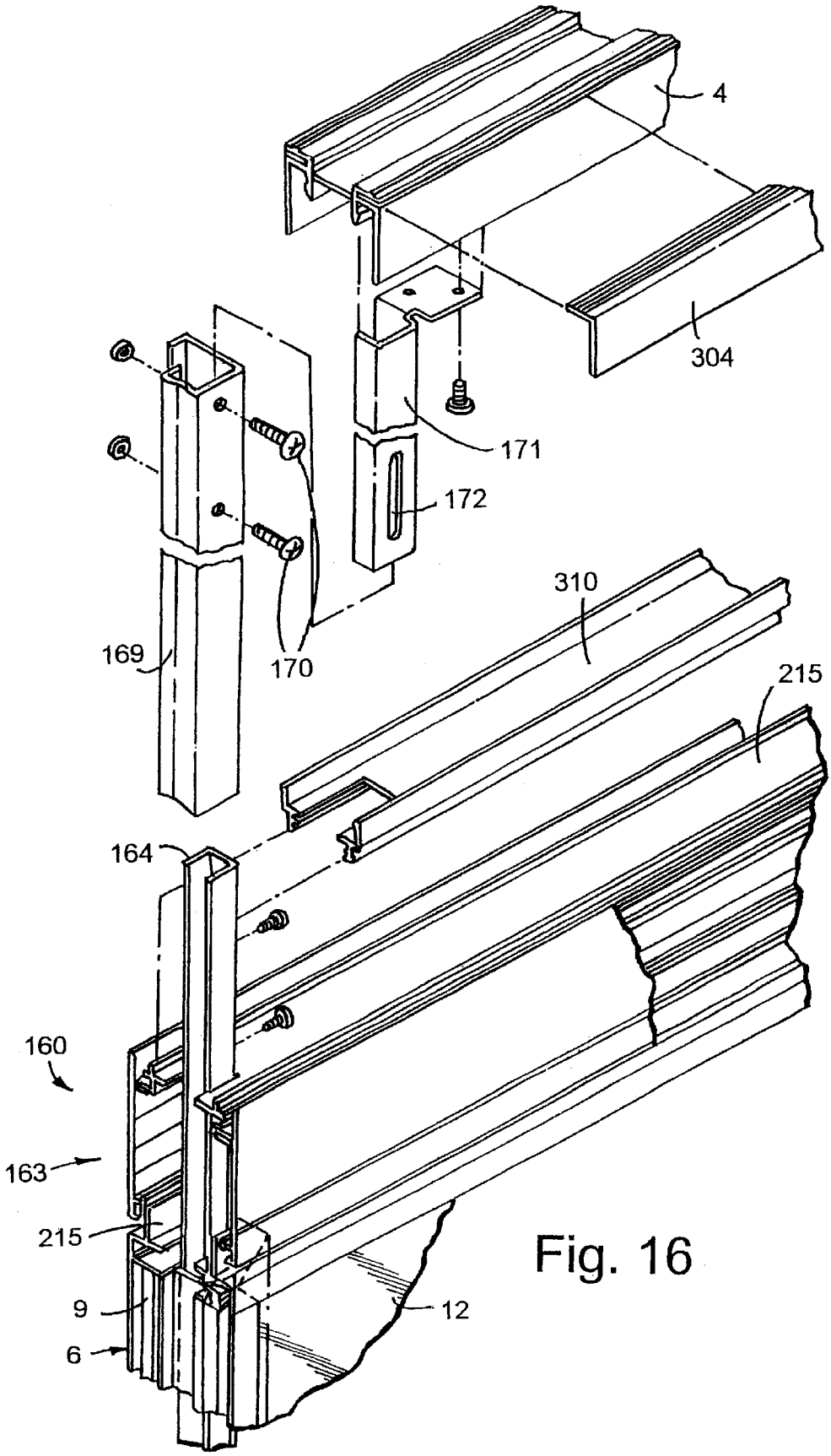
FIG. 16 is a fragmentary, exploded perspective view of the glass panel of FIG. 15 showing an adjustable height support that extends between the frame and the ceiling track.
Figure 17:
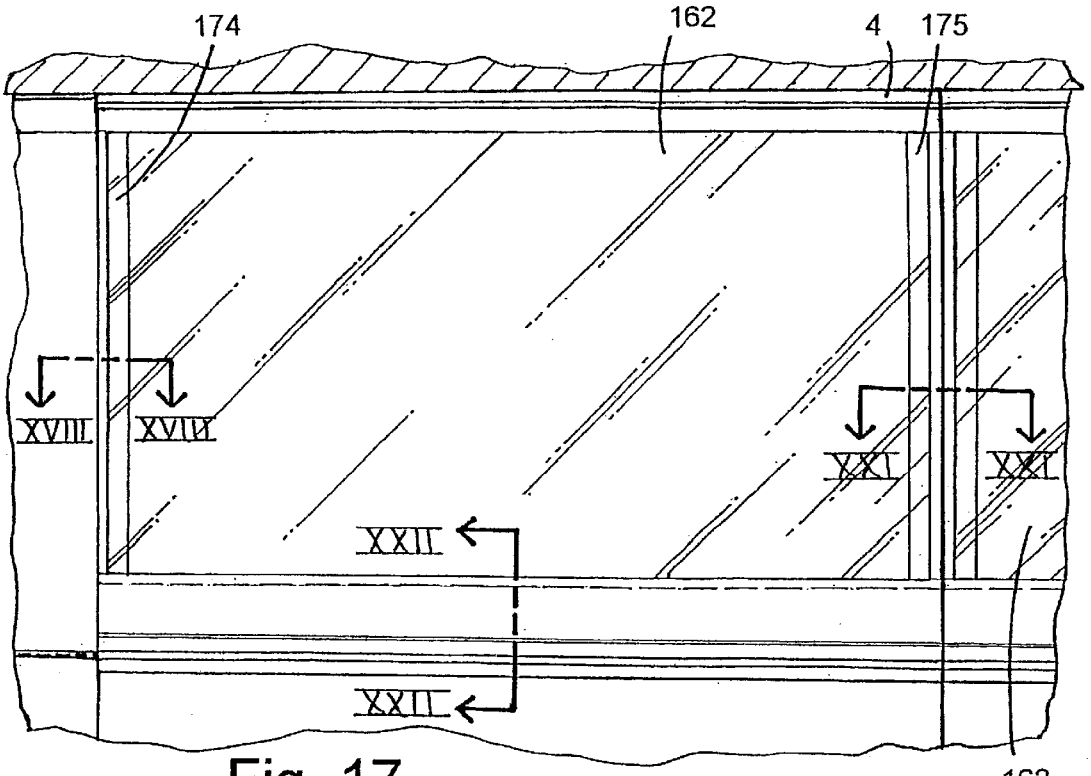
FIG. 17 is a front elevational view of an upper glass module.

A glass panel 160 is assembled in a similar manner as that described above, except that horizontal expressway member 215 is connected to vertical side frame members 9, 10 rather than upper horizontal frame member 7. Structural extensions 169 and brackets 171 are then used to interconnect stanchions 164 with the ceiling track 4 (FIG. 16). A glass module 286 or cover panels are then installed above the expressway 163 as described above.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the Doctrine of Equivalents.

The invention claimed is:

1. A movable transparent panel for reconfigurable floor-to-ceiling office partitions, comprising:

a floor track shaped to be supported on a floor surface;

a ceiling track shaped to be supported on a ceiling surface;

a panel frame supported in a normally vertical orientation between said floor track and said ceiling track, and having vertically spaced-apart upper and lower horizontal frame members with a pair of vertical side frame members interconnecting said upper and lower horizontal members and extending therebetween to define a generally quadrilateral opening, wherein said upper horizontal frame member is connected to said ceiling track and said lower horizontal frame member is adjustably connected with said floor track, each vertical side member having a front face;

a substantially transparent sheet extending across at least a portion of said opening and having vertical side edges;

a vertically adjustable support retaining said panel frame at a selected height above said floor track to permit height adjustment and leveling of said panel frame to account for variations in the floor surface; and retainer strips removably connected to said vertical side members and removably retaining said transparent sheet to said panel frame along said vertical side edges with said transparent sheet positioned in an offset location adjacent said front faces of said vertical side frame members.

2. A movable transparent panel as set forth in claim 1, wherein:

said vertically adjustable support includes a pair of jack screws that are threadably connected to a lower portion of said panel frame, and extend downwardly to abuttingly support said panel frame above the floor track.

3. A movable transparent panel as set forth in claim 2, wherein:

the jack screws are mounted to the vertical side frame members of said panel frame.

4. A movable transparent panel as set forth in claim 3, wherein:

said retainer strips and said vertical side frame members together define inwardly-opening U-shaped channels extending along at least a portion thereof, each vertical side edge of said transparent sheet being received within a selected one of said inwardly-opening U-shaped channels to retain said transparent sheet to said panel frame, said inwardly-opening U-shaped channels having an outer flange defining a front face of said panel such that the transparent sheet is located directly adjacent said front face of the panel.

5. A movable transparent panel as set forth in claim 4, wherein:

said vertical frame members have an outwardly-opening U-shaped channel on said front faces; and said retainer strips have a generally L-shaped cross section defining first and second legs, wherein said second legs of said retainer strips form said outer flanges of said inwardly-opening U-shaped channels, said first leg of each L-shaped retainer strip being releasably retained within said outwardly-opening U-shaped channels in said front faces of said vertical frame members.

6. A movable transparent panel as set forth in claim 5, wherein:

said transparent sheet has upper and lower edges that define a vertical height, said upper and lower horizontal panel frame members defining opposing inner faces that are spaced-apart a distance that is less than said vertical height of said transparent sheet, said upper and lower horizontal members including opposing upper and lower channels, such that said transparent sheet may be installed by inserting said upper edge into said upper channel, followed by insertion of said lower edge of said transparent sheet in said lower channel, such that said transparent sheet is retained within said opposing channels in said panel frame.

7. A movable transparent panel as set forth in claim 1, wherein:

said panel frame includes an intermediate horizontal member rigidly connected to, and extending between said vertical side members, said intermediate horizontal member being located at an overhead position to define upper and lower quadrilateral openings through said panel frame and being shaped to route utilities therein, said transparent sheet extending across at least a portion of said lower opening, said movable transparent panel further comprising;

an adjustable height support extending between and interconnecting said intermediate horizontal member and said ceiling track;

an upper sheet extending across said upper opening, and closing off an associated portion of the same.

8. A movable transparent panel as set forth in claim 7, wherein:

said upper sheet is transparent.

9. A movable transparent panel as set forth in claim 8, wherein:

said lower horizontal frame member includes an upwardly-opening channel retaining a lower edge of said lower transparent sheet, said upper horizontal frame member including a downwardly-opening channel retaining an upper edge of said upper transparent sheet, said intermediate horizontal member including an upwardly-opening channel retaining a lower edge of said upper transparent sheet;

said vertical side frame members have a channel in said front faces;

said retainer strips have a generally L-shaped cross section defining a first leg releasably received within said channels in said front faces to thereby releasably retain said upper and lower transparent sheets to said panel frame.

10. A kit for dividing office spaces comprising:

a floor track shaped to be supported on a floor surface;

a ceiling track shaped to be supported on a ceiling surface;

a pair of horizontal frame members;

a pair of vertical frame members configured to be connected with said horizontal frame members in a, horizontally spaced-apart relationship to define a panel frame having a generally quadrilateral opening therein and a panel frame front face when in an assembled condition; wherein an upper horizontal member is operably connected to said ceiling track when in an assembled condition;

a transparent sheet shaped to be received in said quadrilateral opening;

a retainer strip adapted for connection to said panel frame when in an assembled condition to retain said transparent sheet over said quadrilateral opening in an offset position adjacent said front face; and a base support adapted to interconnect said panel frame with said floor track when in said assembled condition to retain said panel frame at a selected height above said floor track to permit height adjustment and leveling of said panel frame to account for variations of a floor surface.

11. A kit for dividing office spaces as set forth in claim 10, wherein:

said base support includes a pair of jack screws that are adapted to be threadably connected to a lower portion of said panel frame, and extend downwardly and support said panel frame above said floor track.

12. A kit for dividing office spaces as set forth in claim 11, wherein:

said jack screws are adapted to be mounted to said vertical frame members of said panel frame.

13. A kit for dividing office spaces as set forth in claim 12, wherein:

said retainer strip and a selected one of said vertical side frame members together define an inwardly-opening U-shaped channel extending along at least a portion of said selected one of said vertical frame members when assembled; said transparent sheet defining an opposite side edge that is received within said U-shaped channel to retain said transparent sheet to said panel frame when assembled, the U-shaped channel having an outer flange defining a front face of said panel frame such that the transparent sheet is located directly adjacent said front face of said panel frame when assembled.

14. A kit for dividing office spaces as set forth in claim 13, wherein:

each vertical frame member has an outwardly-opening U-shaped channel on said front faces;

said retainer strip having a generally L-shaped cross section defining first and second legs, wherein said second leg of said retainer strip forms said outer flange of said inwardly-opening U-shaped channel when assembled, said first leg of said L-shaped retainer adapted to be releasably retained within a selected one of said outwardly-opening channels in said front faces of said vertical frame members.

15. A kit for dividing office spaces as set forth in claim 14, wherein:

said transparent sheet has upper and lower edges that define a vertical height, said horizontal panel frame members defining opposing inner faces that are spaced-apart a distance that is less than said vertical height of said transparent sheet when assembled, said upper and lower horizontal members including opposing upper and lower channels, such that said transparent sheet may be installed by inserting said upper edge into said upper channel, followed by insertion of said lower edge of said transparent sheet in said lower channel, such that said transparent sheet is retained within said opposing channels in said panel frame when in an assembled condition.

16. A kit for dividing office spaces as set forth in claim 10, wherein:

said panel frame includes an intermediate horizontal member adapted to be rigidly connected to, and extending between said vertical side members when assembled, said intermediate horizontal member being located at an overhead position to define upper and lower quadrilateral openings through said panel frame and being shaped to route utilities therein, said transparent sheet extending across at least a portion of said lower opening, said kit further comprising;

an upper sheet extending across said upper opening, and closing off an associated portion of the same.

17. A kit for dividing office spaces as set forth in claim 16, wherein:

said upper sheet is transparent.

18. A kit for dividing office spaces as set forth in claim 17, wherein:

said pair of horizontal frame members includes an upper horizontal frame member and a lower horizontal frame member;

said lower horizontal frame member includes an upwardly-opening channel retaining a lower edge of said lower transparent sheet, said upper horizontal frame member including a downwardly-opening channel retaining an upper edge of said upper transparent sheet, said intermediate horizontal member including an upwardly-opening channel retaining a lower edge of said upper transparent sheet;

said retainer strip having a generally L-shaped cross section defining a first leg releasably received within a selected one of said channels in said front faces to thereby releasably retain said upper and lower transparent sheets to said panel frame.

19. A kit for dividing office spaces as set forth in claim 10, wherein:

said vertical frame members have a construction that permits cutting said vertical frame members during on-site installation.

20. A movable transparent panel for reconfiguring floor-to-ceiling office partitions comprising:

a floor track shaped to be supported on a floor surface;

a ceiling track shaped to be supported on a ceiling surface, and defining a vertical height between said ceiling track and said floor track;

a rigid panel frame supported in a normally vertical orientation between said floor track and said ceiling track, and having a height less than said vertical height, said panel frame defining a front face;

said panel frame having a base portion operably connected with said floor track and a top portion spaced vertically apart from said ceiling track;

a variable height panel support extending between and connected with said panel frame top portion and said ceiling track; said panel support being vertically extensible and including a lock which rigidly retains said panel support at a selected height; and a single transparent sheet removably connected to said panel frame in an offset position adjacent said front face.

21. A movable transparent panel as set forth in claim 20, wherein:

said panel frame includes vertically spaced-apart upper and lower horizontal frame members with a pair of vertical side members interconnecting said upper and lower horizontal members to define a quadrilateral opening that is enclosed by said transparent sheet.

22. A movable transparent panel as set forth in claim 21, including:

a vertically adjustable support retaining said panel frame at a selected height above said floor track to permit height adjustment and leveling of said panel frame to account for variations in the floor surface.

23. A movable transparent panel as set forth in claim 22, wherein:

the vertically adjustable support includes a pair of jack screws that are threadably connected to a lower portion of said panel frame, and extend downwardly to abuttingly support said panel frame above the floor track.

24. A movable transparent panel as set forth in claim 23, wherein:

said jack screws are mounted adjacent said vertical side members of said panel frame, said movable transparent panel further including:

vertically-extending covers detachably connected to each vertical side member and defining a pocket therebetween; at least a portion of each jack screw being disposed within said pocket.

25. A movable transparent panel as set forth in claim 24, wherein:

said floor track and said ceiling track define therebetween a floor-to-ceiling height when installed, and wherein said vertical frame members have a predetermined length that is greater than said floor-to-ceiling height to permit cutting said vertical frame members to a length corresponding to said floor-to-ceiling height during installation of said movable transparent panel.

26. A movable transparent panel as set forth in claim 25, including:

an elongated retainer connected to each vertical side member, and wherein:

each of the vertical side members of the panel frame and said elongated retainer together form an inwardly-opening U-shaped channel extending along at least a portion thereof, the transparent sheet defining opposite side edges, each side edge being received within a U-shaped channel to retain said transparent sheet to said panel frame, said U-shaped channel having an outer flange defining a front face of said panel such that said transparent sheet is located directly adjacent said front face of said panel.

27. A movable transparent panel as set forth in claim 26, wherein:

each vertical frame member has an outwardly-opening U-shaped channel in said front faces;

said retainer has a generally L-shaped cross section defining first and second legs, wherein said second leg of said retainer forms said outer flange of said inwardly-opening U-shaped channel, said first leg being releasably retained within a selected one of said outwardly-opening U-shaped said channels in said front faces of said vertical frame members.

28. A movable transparent panel as set forth in claim 27, wherein:

said transparent sheet has upper and lower edges that define a vertical height, said upper and lower horizontal panel frame members defining opposing inner faces that are spaced-apart a distance that is less than said vertical height of said transparent sheet, said upper and lower horizontal members including opposing upper and lower channels, such that said transparent sheet may be installed by inserting said upper edge into said upper channel, followed by insertion of said lower edge of said transparent sheet in said lower channel, such that said transparent sheet is retained within said opposing channels in said panel frame.

29. A movable transparent panel as set forth in claim 28, wherein:

said panel frame includes an intermediate horizontal member rigidly connected to, and extending between said vertical side members, said intermediate horizontal member being located at an overhead position to define upper and lower quadrilateral openings through said panel frame, said transparent sheet extending across at least a portion of said lower opening, said movable transparent panel further comprising;

an upper sheet extending across said upper opening, and closing off an associated portion of the same.

30. A movable transparent panel for reconfigurable floor-to-ceiling office partitions comprising:

a rigid panel frame having an upper horizontal frame member shaped to support an upper portion of said panel frame on a ceiling surface, and a lower horizontal frame member shaped to support said panel frame on a floor surface, said panel frame including a pair of vertical frame members interconnected with said upper and lower horizontal frame members, said vertical frame members defining at least one front face;

said panel frame further including an elongated horizontal expressway member having opposite ends connected to said panel frame, said expressway member being located at an overhead position and being shaped to receive utilities therein through outwardly-opening sides;

said expressway member dividing said panel frame to define upper and lower quadrilateral openings;

at least one cover panel detachably mounted on said horizontal expressway member and enclosing at least a portion of a selected one of said outwardly-opening sides;

an upper sheet connected to said panel frame and extending across said upper opening;

a substantially transparent lower sheet defining opposite side edges and extending across said lower opening; and at least two vertical trim strips removably connected to said vertical frame members adjacent said front faces and retaining said side edges of said transparent lower sheet, such that said transparent sheet is offset towards said front face.

31. A movable transparent panel as set forth in claim 30, wherein:

said expressway member includes oppositely-opening horizontal channels with a vertical web extending therebetween.

32. A movable transparent panel as set forth in claim 31, wherein:

said upper sheet is transparent.

33. A movable transparent panel as set forth in claim 32, wherein:

said upper sheet is opaque.

34. A movable transparent panel as set forth in claim 30, including:

a floor track operably connected with said lower horizontal frame member, and shaped to be supported on a floor surface;

a ceiling track operably connected to said upper horizontal member, and shaped to be supported on a ceiling surface;

a vertically adjustable support retaining said panel frame at a selected height above said floor track to permit height adjustment and leveling of said panel frame to account for variations in the floor surface.

35. A movable transparent panel as set forth in claim 34, wherein:

said vertically adjustable support includes a pair of jack screws that are threadably connected to a lower portion of said panel frame, and extend downwardly to abuttingly support said panel frame above the floor track.

36. A movable transparent panel as set forth in claim 35, wherein:

said upper horizontal frame member includes an upwardly-extending flange, and wherein said movable transparent panel further includes:

an elongated retainer removably connected to said upper horizontal frame member, said upwardly-extending flange and said elongated retainer abutting opposite side faces of said ceiling track to thereby retain said panel frame in a vertically disposed orientation.

37. A movable transparent panel as set forth in claim 36, wherein:

said vertical frame members include a channel in said front faces, and wherein said movable transparent panel further includes:

at least two retainers having an L-shaped cross section defining first and second legs, said first legs being removably received within said channels, said second legs extending over said side edge of said lower transparent sheet and removably retaining the same to said panel frame.

38. A movable transparent panel as set forth in claim 37, wherein:

said expressway member includes a vertical web and pair of upwardly-extending flanges defining with said vertical web a pair of side-by-side U-shaped channels to retain utilities therein.

39. A movable transparent panel as set forth in claim 38, wherein:

said upper sheet extends downwardly and closes off a selected one of said outwardly-opening sides of said expressway member.

40. A method of dividing office spaces comprising:

providing a first panel frame having a first front face and a first transparent sheet mounted to said first panel frame in an offset position adjacent said first front face;

providing a planar rectangular second transparent sheet defining a height and width;

providing upper and lower horizontal frame members;

providing a pair of vertical side frame members having a predetermined length that is greater than the floor-to-ceiling spacing of the office space to be divided;

cutting said side frame members to a length corresponding to the floor-to-ceiling spacing of the office space to be divided at the installation site;

assembling said frame members to define a second panel frame having rectangular perimeter and at least one second front face;

connecting said second transparent sheet to said second panel frame in an offset position adjacent said second front face; and connecting said second panel frame to the floor and to the ceiling in a vertically disposed orientation with said second transparent sheet in a coplanar position with said first transparent sheet.

41. A method as set forth in claim 40, including:

providing a floor track;

securing said floor track to the floor; and connecting said lower frame member to said floor track.

42. A method as set forth in claim 41, including:

providing a ceiling track;

securing said ceiling track to the ceiling; and connecting said upper frame member to said ceiling track.

43. A method of dividing office spaces comprising:

providing a planar rectangular transparent sheet defining a height and width;

providing upper and lower horizontal frame members;

providing a pair of vertical side frame members having a predetermined length that is greater than the floor-to-ceiling spacing of the office space to be divided;

cutting said side frame members to a length corresponding to the floor-to-ceiling spacing of the office space to be divided at the installation site;

assembling said frame members to define a panel frame having rectangular perimeter and at least one front face;

connecting said transparent sheet to said panel frame in an offset position adjacent said front face;

connecting said panel frame to the floor and to the ceiling in a vertically disposed orientation;

providing a floor track;

securing said floor track to the floor;

connecting said lower frame member to said floor track;

providing a ceiling track;

securing said ceiling track to the ceiling;

connecting said upper frame member to said ceiling track;

said panel frame includes a pair of jack screws threadably connected to said panel frame along a lower edge thereof, said jack screws extending downwardly to adjustably support said panel frame above said floor track; and wherein said method includes:

adjusting said jack screws to support said panel frame at a selected vertical location relative to the floor.

44. A method as set forth in claim 43, wherein:

said upper horizontal frame member includes an upwardly-extending flange, said method further including:

providing an elongated retainer;

positioning said lower horizontal member of said panel frame on said floor track;

rotating said panel frame towards a vertically disposed position until said upwardly-extending flange of said upper horizontal frame member abuts a side face of said ceiling track; and connecting said elongated retainer to said horizontal upper frame member in an abutting relationship with an opposite side face of said ceiling track such that said panel frame member is retained in a vertically disposed orientation.

45. A method as set forth in claim 44, wherein:

said upper horizontal frame member includes a downwardly-opening channel, and said lower frame member includes an upwardly-opening channel, said method including:

inserting a lower edge of said transparent sheet into said channel of said upper horizontal frame member;

rotating said transparent sheet into a position wherein a lower edge of the transparent sheet is aligned with said channel in said lower horizontal frame member; and inserting said lower edge of said transparent sheet into said channel in said lower horizontal frame member.

46. A method as set forth in claim 45, wherein:

said vertical side frame members have at least one front face with a vertically-extending channel therein, said method further including:

providing a plurality of L-shaped retainer strips, each defining first and second legs;

attaching a retainer strip to each vertical side frame member by inserting said first leg into said channel in each said vertical side frame member to thereby removably retain side edges of said transparent sheet to said panel frame.

47. A method as set forth in claim 46, including:

providing an intermediate horizontal expressway member;

connecting said horizontal expressway member at opposite ends thereof to said vertical side frame members at an overhead position;

placing utility lines in said horizontal expressway member.

48. A method as set forth in claim 46, wherein:

said transparent sheet has a predetermined height that is greater than the floor-to-ceiling spacing of the office space to be divided, said method including:

cutting said transparent sheet to a height corresponding to said floor-to-ceiling spacing of the office space to be divided prior to connecting said transparent sheet to said panel frame.

49. A method as set forth in claim 48, wherein:

said transparent sheet comprises a rectangular glass sheet, said method including:

tempering said glass sheet after cutting said glass sheet to a height corresponding to said floor-to-ceiling spacing.

50. A movable transparent panel for reconfigurable floor-to-ceiling office partitions comprising:

a floor track shaped to be supported on a floor surface;

a ceiling track shaped to be supported on a ceiling surface, said ceiling track defining first and second opposite side faces;

a rigid panel frame defining a quadrilateral opening and a base portion therebelow operably connected with said floor track;

a transparent sheet connected to said panel frame and extending across said opening;

said panel frame having an upper portion with an upwardly-protruding flange abutting a first opposite side face of said ceiling track upon rotation of said panel frame to a vertical position over said floor track; and a retainer removably connected to said upper portion of said panel frame and abutting said second opposite side face of said ceiling track to removably retain said panel frame in a vertically disposed position.

51. A movable transparent panel for reconfigurable floor-to-ceiling office partitions comprising:

a floor track shaped to be supported on a floor surface;

a ceiling track shaped to be supported on a ceiling surface, said ceiling track defining first and second opposite side faces;

a rigid panel frame defining a quadrilateral opening and a base portion therebelow operably connected with said floor track;

a transparent sheet connected to said panel frame and extending across said opening;

said panel frame having an upper portion with an upwardly-protruding flange abutting said first opposite side face of said ceiling track upon rotation of said panel frame to a vertical position over said floor track;

a retainer removably connected to said upper portion of said panel frame and abutting said second opposite side face of said ceiling track to removably retain said panel frame in a vertically disposed position;

a vertically adjustable support retaining said panel frame at a selected height above said floor track to permit height adjustment and leveling of said frame to account for variations in the floor surface.

52. A movable transparent panel as set forth in claim 51, wherein:

said vertically adjustable support includes a pair of jack screws that are threadably connected to a lower portion of said panel frame, and extend downwardly to abuttingly support said panel frame above the floor track.

53. A movable transparent panel as set forth in claim 52, including:

an elongated retainer connected to each vertical side member, and wherein:

each of the vertical side members of the panel frame and said elongated retainer together form an inwardly-opening U-shaped channel extending along at least a portion thereof, said transparent sheet defining opposite side edges, each side edge being received within a U-shaped channel to retain said transparent sheet to said panel frame, said U-shaped channel having an outer flange defining a front face of said panel such that the transparent sheet is located directly adjacent said front face of the panel.

54. A movable transparent panel as set forth in claim 53, including:

a retainer having a generally L-shaped cross section defining first and second legs, wherein said second leg of said retainer forms said outer flange of said inwardly-opening U-shaped channel, said front faces of said vertical frame members including outwardly-opening channels therein, said first leg of each L-shaped retainer being releasably retained within a selected outwardly-opening channel in said front face of said vertical frame members.

55. A movable transparent panel as set forth in claim 54, wherein:

said transparent sheet has upper and lower edges that define a vertical height, said upper and lower horizontal panel frame members defining opposing inner faces that are spaced-apart a distance that is less than said vertical height of said transparent sheet, said upper and lower horizontal members including opposing upper and lower channels, such that said transparent sheet may be installed by inserting said upper edge into said upper channel, followed by insertion of said lower edge of said transparent sheet in said lower channel, such that said transparent sheet is retained within said opposing channels in said panel frame.

56. A movable transparent panel as set forth in claim 51, wherein:

said rigid panel frame includes vertically spaced-apart upper and lower horizontal frame members, and horizontally spaced-apart vertical frame members rigidly interconnecting said upper and lower horizontal frame members to define said quadrilateral opening and a quadrilateral perimeter;

said vertical frame members having a predetermined length that is greater than said floor-to-ceiling height, thereby permitting said vertical frame members to be cut to a length corresponding to the floor-to-ceiling height at the installation site, such that said rigid panel frame can be fitted and assembled at the installation site.

57. A movable transparent panel as set forth in claim 56, wherein:

said lower horizontal frame member includes screw bosses at opposite ends thereof, said screw bosses receiving fasteners to rigidly connect said vertical side frame members to said lower horizontal frame member at opposite ends thereof.

58. A movable transparent panel as set forth in claim 51, wherein:

said floor track includes upwardly-extending sidewalls, said lower horizontal frame member being closely received within said sidewalls of said floor track to thereby permit height adjustment of said panel frame.

59. A movable transparent panel as set forth in claim 58, wherein:

said upwardly-extending sidewalls of said floor track comprise elongated base trim members that are removably connected to said lower horizontal frame member.

60. A movable transparent panel for reconfigurable office partitions comprising:

a panel frame having vertically spaced-apart upper and lower horizontal frame members, and a pair of horizontally spaced-apart vertical frame members extending therebetween and rigidly interconnecting said upper and lower frame members to define a generally quadrilateral opening;

a substantially transparent sheet defining opposite side edges and extending across said quadrilateral opening;

an elongated retainer connected to said panel frame; and wherein said elongated retainer and said vertical frame members together form an inwardly-opening U-shaped channel said vertical frame members defining inner and outer faces, and front and rear faces, said front faces forming junctions with said outer faces, said vertical frame members including an inwardly-opening U-shaped channel extending along at least a portion of each said vertical frame member adjacent said junction, said side edges of said transparent sheet being positioned adjacent said junctions and received within said inwardly-opening U-shaped channels to retain said transparent sheet to said panel frame in an offset position adjacent said front face of said panel, said inner face having a portion that extends inwardly and rearwardly from said junction, thereby reducing the width of said vertical frame members when viewed at an angle relative to said panel frame.

61. A movable transparent panel as set forth in claim 60, including:

a floor track operably connected to said lower frame member and shaped to be supported on a floor surface;

a ceiling track operably connected to said upper frame member and shaped to be supported on a ceiling surface;

a vertically adjustable support retaining said panel frame at a selected height above said floor track to permit height adjustment and leveling of said frame to account for variations in the floor surface.

62. A movable transparent panel as set forth in claim 61, wherein:

said ceiling track is vertically spaced-apart from said floor track to define a vertical height;

said vertical frame members have a predetermined length that is greater than said vertical height, thereby permitting said vertical frame members to be cut to a length corresponding to the vertical height at the installation site, thereby permitting said rigid panel frame to be fitted and assembled at the installation site.

63. A movable transparent panel as set forth in claim 62, wherein:

said outer flange of said inwardly-opening U-shaped channel comprises a second leg of an L-shaped retainer strip;

said vertical frame members have an outwardly-opening channel extending along said front faces;

said L-shaped retainer having a first leg removably retained within said outwardly-opening channel.

64. A movable transparent panel as set forth in claim 63, wherein:

said upper horizontal frame member includes an upwardly-extending flange, said transparent panel including:

an elongated retainer member removably connected to said upper horizontal frame member, said upwardly-extending flange and said retainer member abutting opposite side faces of sail ceiling track to thereby retain said transparent panel in a vertically disposed orientation.

65. A movable transparent panel as set forth in claim 64, wherein:

said vertical frame members and said upper and lower horizontal frame members are extruded aluminum.

66. A movable transparent panel as set forth in claim 65, wherein:

the jack screws are mounted to the vertical side members of said panel frame.

67. A movable transparent panel as set forth in claim 66, wherein:

said panel frame includes an intermediate horizontal member rigidly connected to, and extending between said vertical side members, said intermediate horizontal member being located at an overhead position to define upper and lower quadrilateral openings through said panel frame, said transparent sheet being removably connected to said panel frame and extending across at least a portion of said lower opening, said movable transparent panel further comprising;

an upper sheet extending across said upper opening, and closing off an associated portion of the same.

68. A movable transparent panel as set forth in claim 67, wherein:

said upper sheet is transparent.

69. A movable transparent panel as set forth in claim 68, wherein:

said lower horizontal frame member includes an upwardly-opening channel retaining a lower edge of said lower transparent sheet, said upper horizontal frame member including a downwardly-opening channel retaining an upper edge of said upper transparent sheet, said intermediate horizontal member including an upwardly-opening channel retaining a lower edge of said upper transparent sheet, said panel further including;

retainer strips having a generally L-shaped cross section defining a first leg releasably received within a selected one of said channels in said front faces to thereby releasably retain said upper transparent sheet to said panel frame.

70. A movable panel for reconfigurable office partitions comprising:

a panel frame having vertically spaced-apart upper and lower frame members, and a pair of horizontally spaced-apart vertical frame members extending therebetween and rigidly interconnecting said upper and lower frame members to define a rectangular perimeter and a rectangular opening through said panel frame, said panel frame having and opposed front and rear faces, said front face having a vertically-extending channel, said frame members having inner faces defining the perimeter of said rectangular opening;

a light-transmitting sheet extending across said frame and defining opposite side edges said light-transmitting sheet positioned in an offset position and extending over and abutting said front face; and a pair of retainer strips having an extension retained within a selected channel in said front faces and an outer flange extending over a portion of said light-transmitting sheet along a side edge thereof to retain said sheet to said front face panel frame.

71. A movable panel for reconfigurable office partitions comprising:

a panel frame having vertically spaced-apart upper and lower frame members, and a pair of horizontally spaced-apart vertical frame members extending therebetween and rigidly interconnecting said upper and lower frame members to define a rectangular perimeter and a front face having a vertically-extending channel;

a light-transmitting sheet extending across said frame and defining opposite side edges;

a pair of retainer strips having an extension retained within a selected channel and an outer flange extending over a portion of said light-transmitting sheet along a side edge thereof to retain said sheet to said panel frame;

a floor track operably connected to said lower frame member and shaped to be supported on a floor surface;

a ceiling track operably connected to said upper frame member and shaped to be supported on a ceiling surface; and a vertically adjustable support retaining said panel frame at a selected height above said floor track to permit height adjustment and leveling of said frame to account for variations in the floor surface.

72. A movable panel as set forth in claim 71, wherein:

said vertical frame members and said upper and lower horizontal frame members are extruded aluminum.

73. A movable panel as set forth in claim 70, wherein:

said retainers have a generally L-shaped cross section with a first leg defining said extension, and a second leg defining said outer flange.

74. A movable panel as set forth in claim 73, wherein:

said vertical channels face outwardly and have a generally U-shaped cross section with a base wall and inner and outer sidewalls extending therefrom to define an opening opposite said base wall, said vertical frame members including an elongated portion configured to abuttingly support a light-transmitting sheet directly adjacent an outer edge of said inner sidewall, said outer sidewall including a lip extending into the opening of said channel;

said first leg of said retainer strip has a base portion and an end portion extending therefrom at an obtuse angle relative to said base portion to define a V-shape, said first leg further including an extension at the vertex of said V-shape such that upon insertion of said first leg into said channel, said end portion abuts said inner sidewall and said extension abuts said lip, said second leg abutting said light-transmitting sheet adjacent said side edges and generating a moment that is reacted by the first leg to thereby releasably retain said edge of said light-transmitting sheet.

75. A movable panel as set forth in claim 74, including:

a vertically adjustable support having a pair of jack screws that are threadably connected to a lower portion of said panel frame, and extend downwardly to abuttingly support said panel frame above said floor track.

76. A movable panel as set forth in claim 75, including:

a floor track having upwardly-extending sidewalls, said lower horizontal frame member being closely received within said sidewalls of said floor track to thereby permit height adjustment of said panel frame.

77. A movable panel as set forth in claim 76, wherein:

said panel frame includes an intermediate horizontal member rigidly connected to, and extending between said vertical side members, said intermediate horizontal member being located at a generally overhead position to define upper and lower quadrilateral openings through said panel frame, said light-transmitting sheet being removably connected to said panel frame and extending across at least a portion of said lower opening, said movable panel further comprising;

an upper sheet extending across said upper opening, and closing off an associated portion of the same.

78. A movable panel as set forth in claim 77, wherein:

said upper and lower sheet are transparent.

79. A movable panel as set forth in claim 78, wherein:

said lower horizontal frame member includes an upwardly-opening channel retaining a lower edge of said lower transparent sheet, said upper horizontal frame member including a downwardly-opening channel retaining an upper edge of said upper transparent sheet, said intermediate horizontal member including an upwardly-opening channel retaining a lower edge of said upper transparent sheet;

said vertical side members and said intermediate horizontal member each including an outwardly-opening retainer channel in a front face thereof, said panel further including;

a plurality of retainer strips having L-shaped cross sections defining a first leg releasably received within a selected one of said retainer channels in said front faces to thereby releasably retain said upper and lower transparent sheets to said panel frame.

80. An edge support releasably retaining the edge of a transparent sheet, comprising:

an elongated panel frame member having a retainer channel extending therealong, said retainer channel defining a base wall with inner and outer side walls extending therefrom to define a generally U-shaped cross section with an opening opposite said base wall, said outer side wall of said channel directly adjacent an outer face of said panel frame member, said frame member including an elongated portion configured to abuttingly support a transparent sheet directly adjacent an outer edge of said inner side wall, said outer side wall including a lip extending into the opening of said retainer channel;

a retainer strip having a generally L-shaped cross section defining first and second legs, said first leg having a base portion and an end portion extending therefrom at an obtuse angle relative to said base portion to define a V-shape, said first leg further including an extension at the vertex of frame V-shape such that upon insertion of said first leg into said retainer channel, said end portion abuts said inner side wall and said extension abuts said lip, said second leg abutting the transparent sheet adjacent an edge thereof and generating a moment that is reacted by the first leg to thereby releasably retain the edge of the transparent sheet;

said retainer channel extending along a front face of said panel frame member, such that when in an assembled condition said second leg of said retainer strip defines a front face of the panel frame;

said elongated panel frame member comprising a vertical frame member and including screw bosses extending therealong for rigidly interconnecting said frame member with upper and lower vertically spaced-apart horizontal frame members; and a pair of jack screws threadably received along a lower edge of said panel frame and extending therefrom to abuttingly support said panel frame member above a floor to permit height adjustment and leveling of said panel frame to account for variations in the floor surface.

81. A movable transparent panel for reconfigurable floor-to-ceiling office partitions comprising:

a panel frame having upper and lower vertically spaced-apart horizontal frame members and a pair of horizontally spaced-apart vertical frame members rigidly interconnecting said upper and lower frame members to define a rectangular perimeter and a rectangular opening through said panel frame;

a transparent sheet connected to said panel frame and extending across said rectangular opening;

a pair of elongated covers removably connected to said vertical frame members, each cover having a U-shaped cross section formed by first and second webs defining an angle therebetween that is greater than ninety degrees to thereby provide a panel frame having substantially uniform, uninterrupted external surfaces extending along said vertical frame members;

a floor track operably connected to said upper horizontal frame member and shaped to be supported on a floor surface;

a ceiling track operably connected to said upper horizontal frame member and shaped to be supported on a ceiling surface; and a vertically adjustable support retaining said panel frame at a selected height above said floor track to permit height adjustment and leveling of said panel frame to account for variations in the floor surface.

82. A movable transparent panel as set forth in claim 81, wherein:

said vertical frame members have a predetermined length that is greater than a floor-to-ceiling spacing defined by said floor track and said ceiling track such that said vertical frame members can be cut to a length corresponding to said floor-to-ceiling spacing at the installation site prior to assembly of said panel frame.

83. A movable transparent panel for reconfigurable floor-to-ceiling office partitions comprising:

a panel frame having upper and lower vertically spaced-apart horizontal frame members and a pair of horizontally spaced-apart vertical frame members rigidly interconnecting said upper and lower frame members to define a rectangular perimeter and a rectangular opening through said panel frame;

a transparent sheet connected to said panel frame and extending across said rectangular opening;

a pair of elongated covers removably connected to said vertical frame members to thereby provide a panel frame having substantially uniform, uninterrupted external surfaces extending along said vertical frame members; and said panel frame including an intermediate horizontal member rigidly connected to, and extending between said vertical frame members, said intermediate horizontal member being located at an overhead position to define upper and lower quadrilateral openings through said panel frame, said transparent sheet being removably connected to said panel frame and extending across at least a portion of said lower opening, said movable transparent panel further comprising;

an upper sheet extending across said upper opening, and closing off an associated portion of the same.

84. A movable transparent panel as set forth in claim 83, wherein:

said upper sheet is transparent.

85. A movable transparent panel as set forth in claim 84, wherein:

said lower horizontal frame member includes an upwardly-opening channel retaining a lower edge of said lower transparent sheet, said upper horizontal frame member including a downwardly-opening channel retaining an upper edge of said upper transparent sheet, said intermediate horizontal member including an upwardly-opening channel retaining a lower edge of said upper transparent sheet;

said vertical side members and said intermediate horizontal member each including a channel in a side face thereof, said panel further including;

a plurality of retainer strips each having a generally L-shaped cross section defining a first leg releasably received within a selected one of said channels in said side faces to thereby releasably retain said upper and lower transparent sheets to said panel frame.

* * * * *

UNITED STATES PATENT AND TRADEMARK OFFICE

CERTIFICATE OF CORRECTION

PATENT NO. : 6,141,925
DATED : November 7, 2000
INVENTOR(S) : Harold Halvorson, Jr. et al.

It is certified that error appears in the above-identified patent and that said Letters Patent is hereby corrected as shown below:

Column 2,
Line 40,"use," should be -- user, --.

Column 3,
Line 27, "herefore" should be -- therefore --.

Column 5,
Line 2, After "ceiling" insert -- in --.
Line 24, "rigidity" should be -- rigidly --.
Line 38, After "having" delete "a".
Line 59, "abutting" should be -- abuttingly --.

Figure 6:
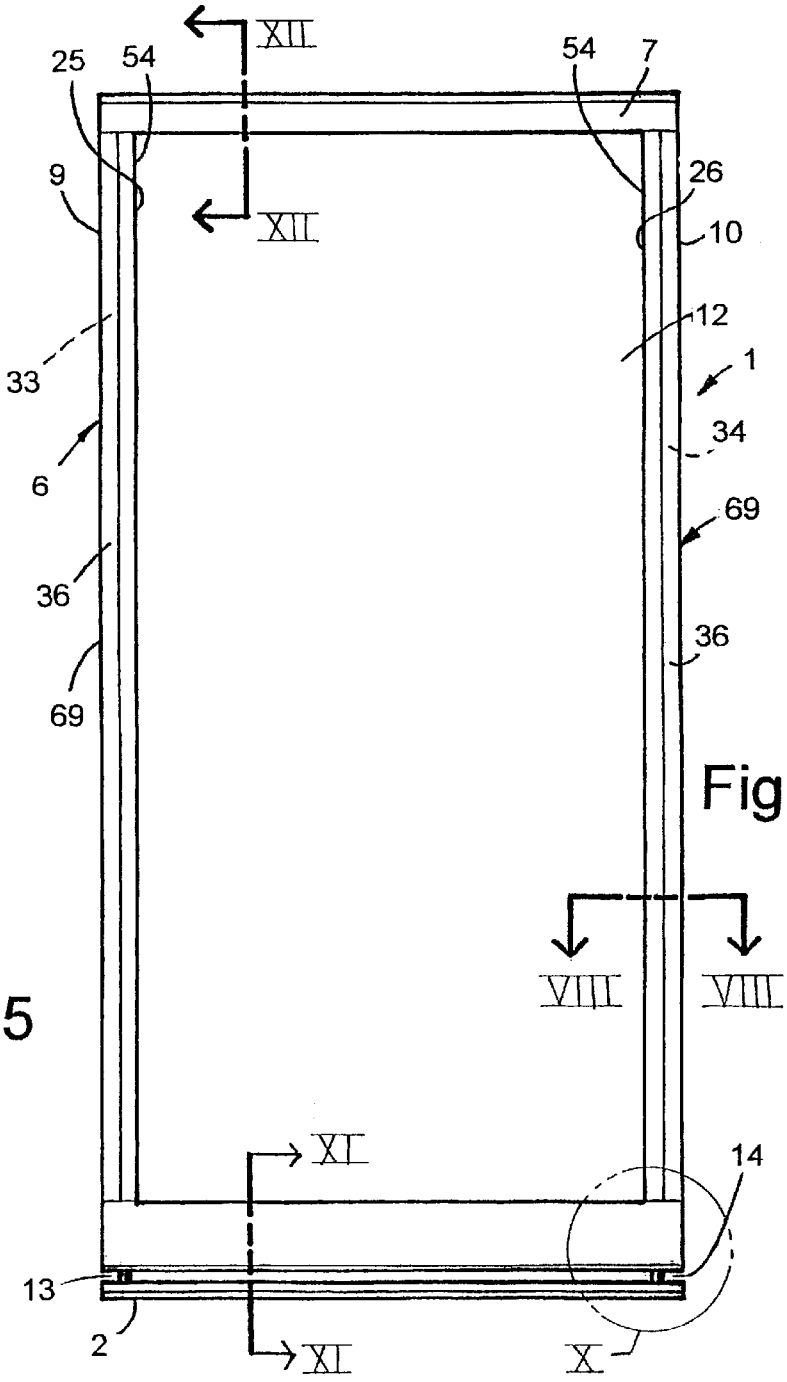
FIG. 6 is a front elevational view of the glass partition.

Fig. 6,
Sheet 5,
Cross section "XII-XII" should be -- XIII-XIII --.

Column 14,
Line 24, "cut-out" should be -- cut out --.

Column 15,
Line 46, "a aesthetic" should be -- an aesthetic --.

Column 25, claim 50,
Line 38, "a" should be -- said --.

Column 28, claim 64,
Line 19, "sail" should be -- said --.

Column 30, claim 78,
Line 27, "sheet" should be -- sheets --.

UNITED STATES PATENT AND TRADEMARK OFFICE

CERTIFICATE OF CORRECTION

PATENT NO. : 6,141,925
DATED : November 7, 2000
INVENTOR(S) : Harold Halvorson, Jr. et al.

It is certified that error appears in the above-identified patent and that said Letters Patent is hereby corrected as shown below:

Column 30, claim 80,
Line 66, "frame" should be -- said --.

Signed and Sealed this

Thirteenth day of November, 2001

*Attest:*

Nicholas P. Godici

NICHOLAS P. GODICI
*Acting Director of the United States Patent and Trademark Office*

*Attesting Officer*